US009862212B2

(12) United States Patent
Fujioka

(10) Patent No.: US 9,862,212 B2
(45) Date of Patent: Jan. 9, 2018

(54) PRINTER

(71) Applicant: Brother Kogyo Kabushiki Kaisha, Nagoya-shi, Aichi-ken (JP)

(72) Inventor: Atsushi Fujioka, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/461,579

(22) Filed: Mar. 17, 2017

(65) Prior Publication Data

US 2017/0282604 A1 Oct. 5, 2017

(30) Foreign Application Priority Data

Mar. 31, 2016 (JP) ..... 2016-071860

(51) Int. Cl.
*B41J 13/00* (2006.01)
*B41J 2/32* (2006.01)
*B41J 11/70* (2006.01)

(52) U.S. Cl.
CPC ..... *B41J 13/0009* (2013.01); *B41J 2/32* (2013.01); *B41J 11/70* (2013.01)

(58) Field of Classification Search
CPC ..... B41J 13/0009; B41J 2/32; B41J 11/70
See application file for complete search history.

(56) References Cited

U.S. PATENT DOCUMENTS 5,884,861 A * 3/1999 Hosomi ..... B26D 1/305 242/563
6,068,170 A * 5/2000 Yamaguchi ..... B26D 1/085 225/101
9,545,803 B2 * 1/2017 Horaguchi ..... B41J 15/16
2011/0292150 A1 12/2011 Ishii et al.

FOREIGN PATENT DOCUMENTS

JP 2001-047717 A 2/2001
JP 2011-245758 A 12/2011

* cited by examiner

*Primary Examiner* — Lamson Nguyen
(74) *Attorney, Agent, or Firm* — Banner & Witcoff, Ltd.

(57) ABSTRACT

The disclosure discloses a printer including a memory storing computer-executable instructions. In an index value detecting process, pulse count index values are detected. In a remaining amount determining process, first process, second process, third process, and fourth process are executed. In the first process, an Nth determination object value is calculated from an Nth and an N+1th pulse count index values. In the second process, an average value is calculated from a plurality of successive pulse count index values in a range including a latest value that is an Nth pulse count index value when N is an even number or is an (N−1)th pulse count index value when N is an odd number of three or more. In the third process, a remaining amount rank corresponding to the Nth determination object value is determined. In the fourth process, a rank display corresponding to the remaining amount rank is performed.

11 Claims, 17 Drawing Sheets

WHILE NUMBER OF INDEX VALUE DATA IS EQUAL TO OR LESS THAN NUMBER CORRESPONDING TO ONE ROUND OF ENCODER (100 IN THIS EXAMPLE), REMAINING AMOUNT IS CALCULATED BY USING ALL DATA UP TO N-TH DETECTED PIECE.

| N | INDEX VALUE | k | DETERMINATION OBJECT VALUE | AVERAGE VALUE TO BE CALCULATED | REMAINING AMOUNT DISPLAY UPDATE | REMAINING AMOUNT DISPLAY LOCK |
|---|---|---|---|---|---|---|
| 1 | P1 | 1 | - | (NOT CALCULATED) | - | - |
| 2 | P2 | 1 | X1 (=P1+P2) | Y1=average (y1) | O | NO |
| 3 | P3 | 2 | X2 (=P2+P3) | Y1=average (y1) | - | - |
| 4 | P4 | 2 | X3 (=P3+P4) | Y2=average (y2) | O | NO |
| 5 | P5 | 3 | X4 (=P4+P5) | Y2=average (y2) | - | - |
| 6 | P6 | 3 | X5 (=P5+P6) | Y3=average (y3) | O | NO |
| 7 | P7 | 4 | X6 (=P6+P7) | Y3=average (y3) | - | - |
| 8 | P8 | 4 | X7 (=P7+P8) | Y4=average (y4) | O | NO |
| 9 | P9 | 5 | X8 (=P8+P9) | Y4=average (y4) | - | - |
| 10 | P10 | 5 | X9 (=P9+P10) | Y5=average (y5) | O | NO |
| ... | ... | ... | ... | ... | ... | ... |

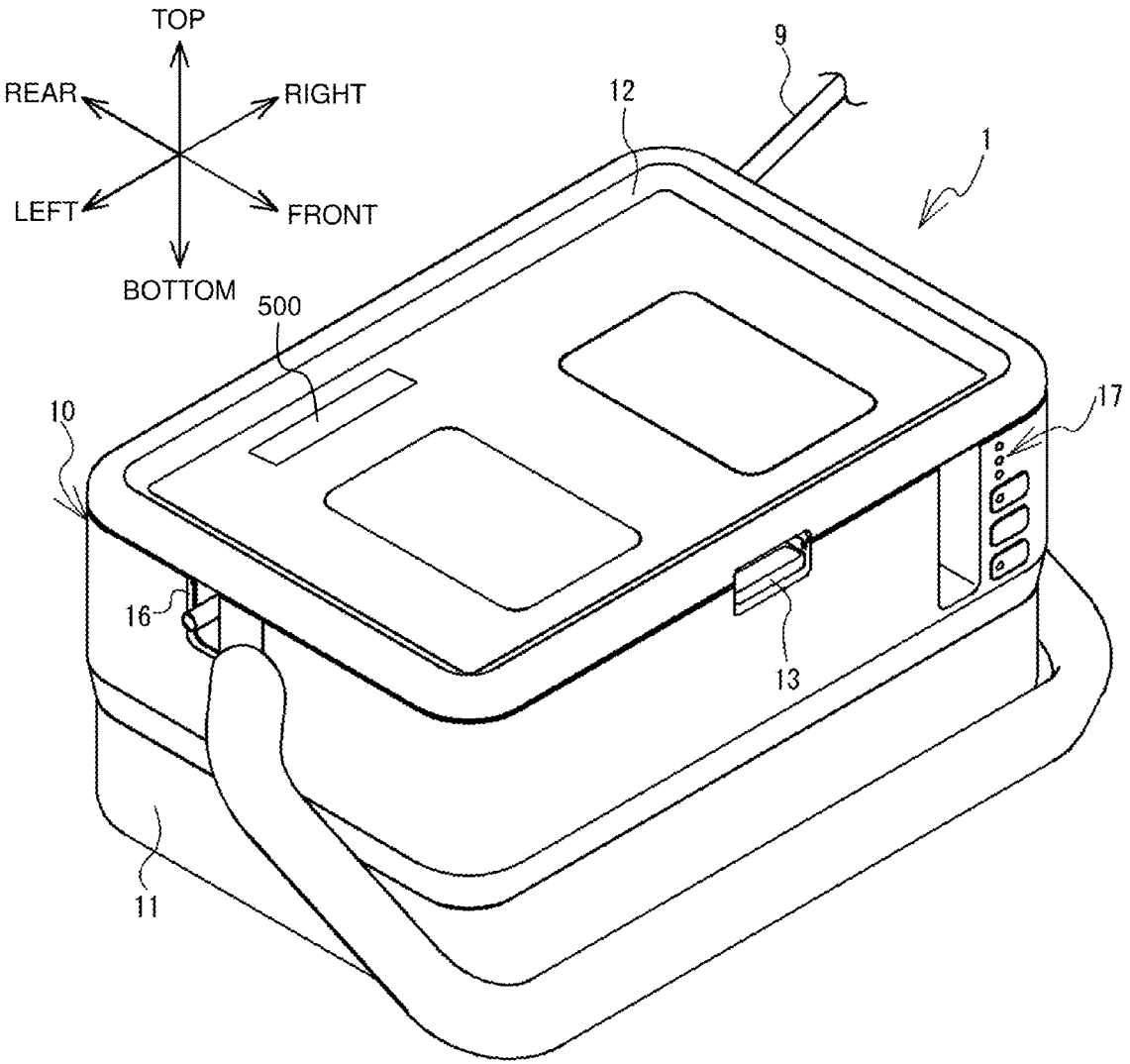
[FIG. 1]

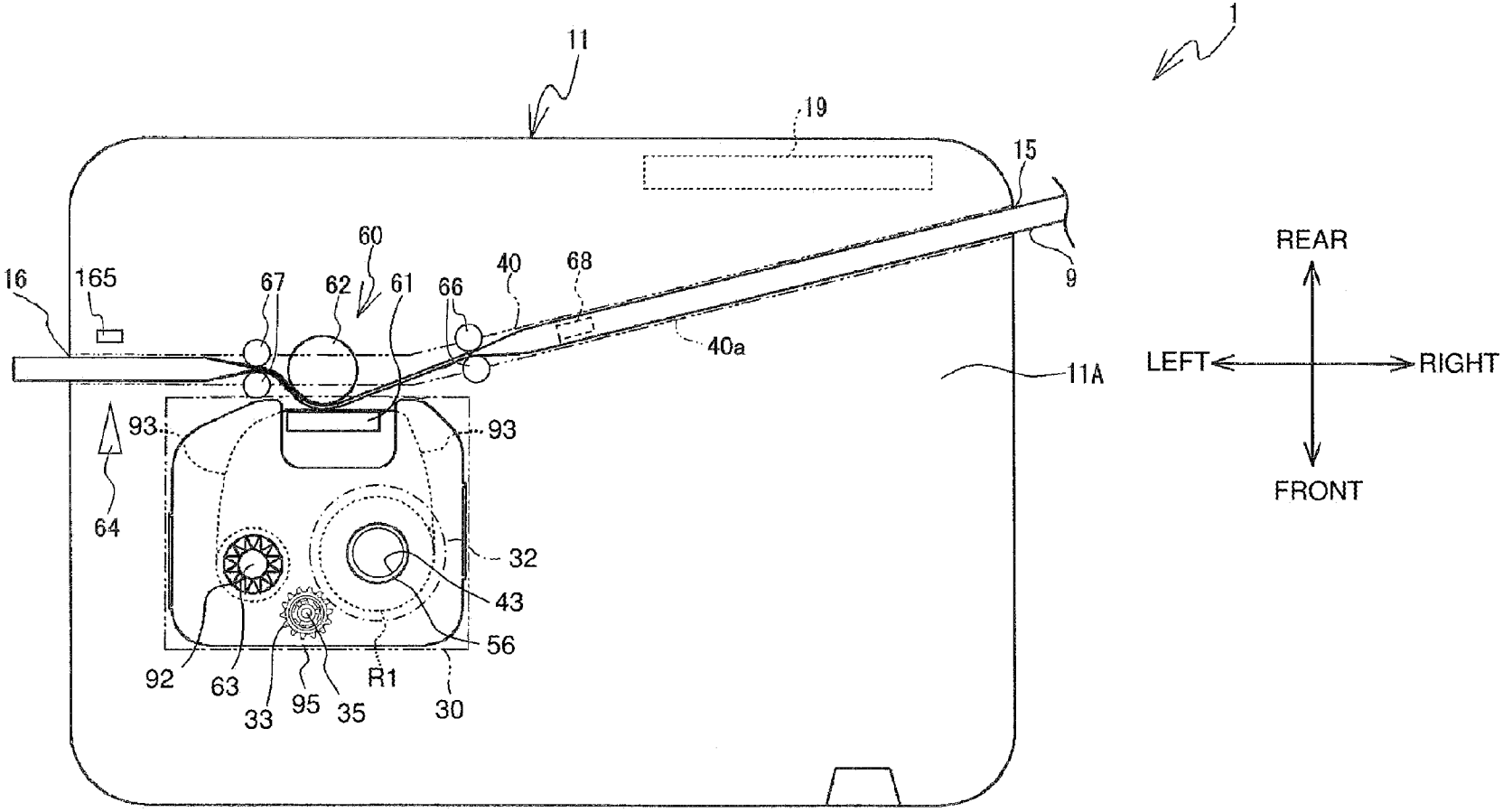
[FIG. 2]

[FIG. 3A]
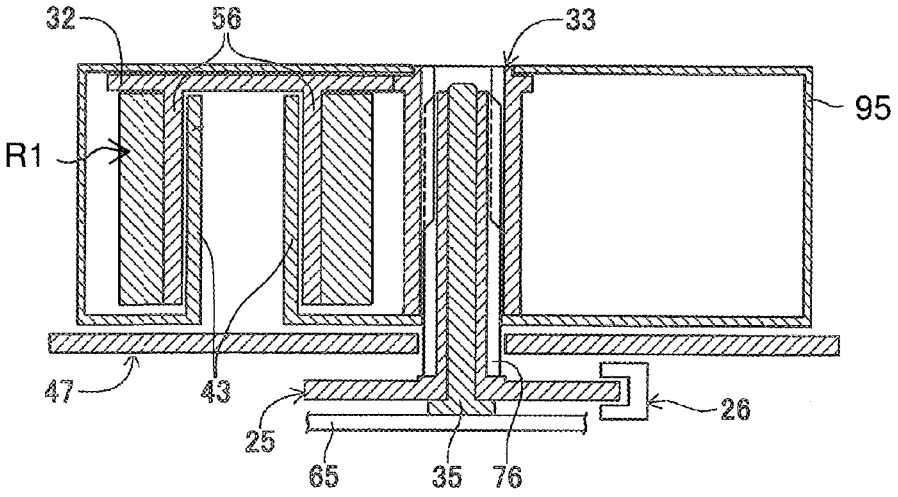
[FIG. 3B]
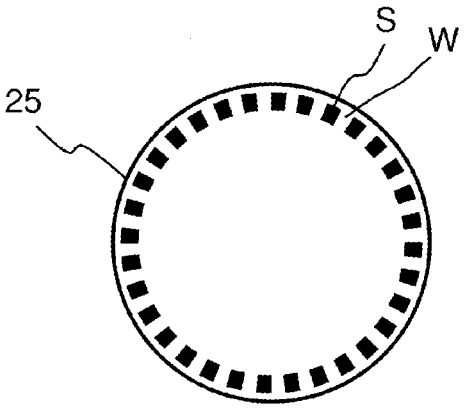

[FIG. 4]
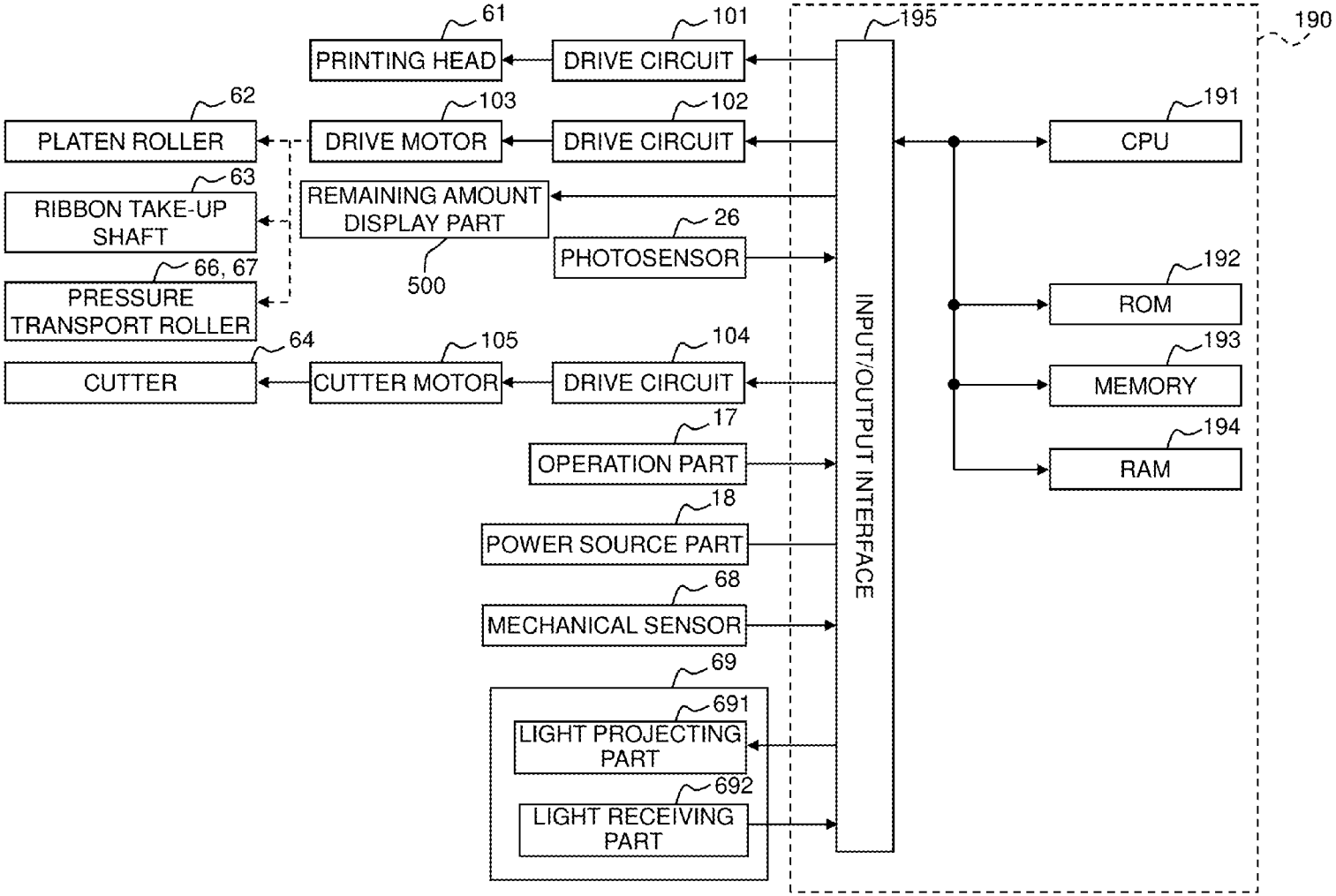

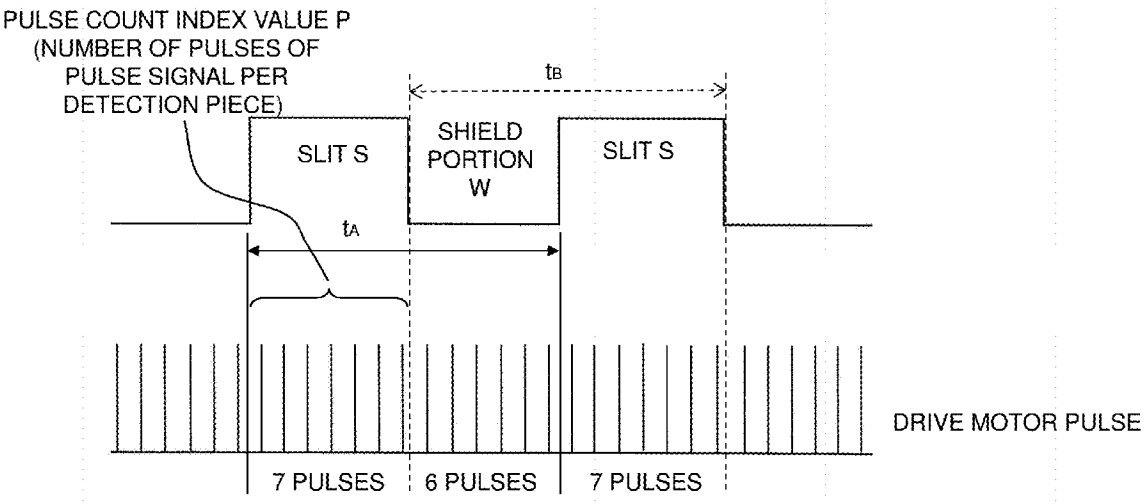
[FIG. 5A]
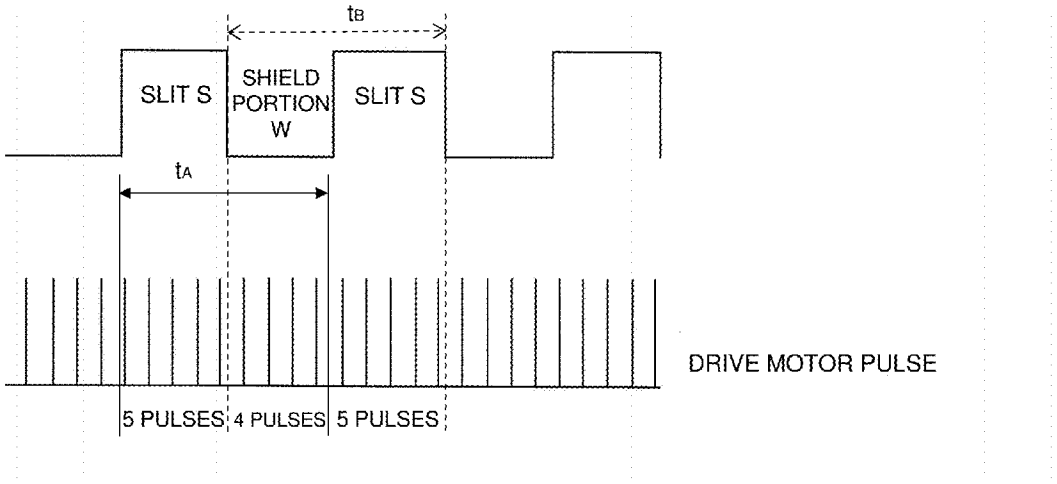
[FIG. 5B]

[FIG. 6A]
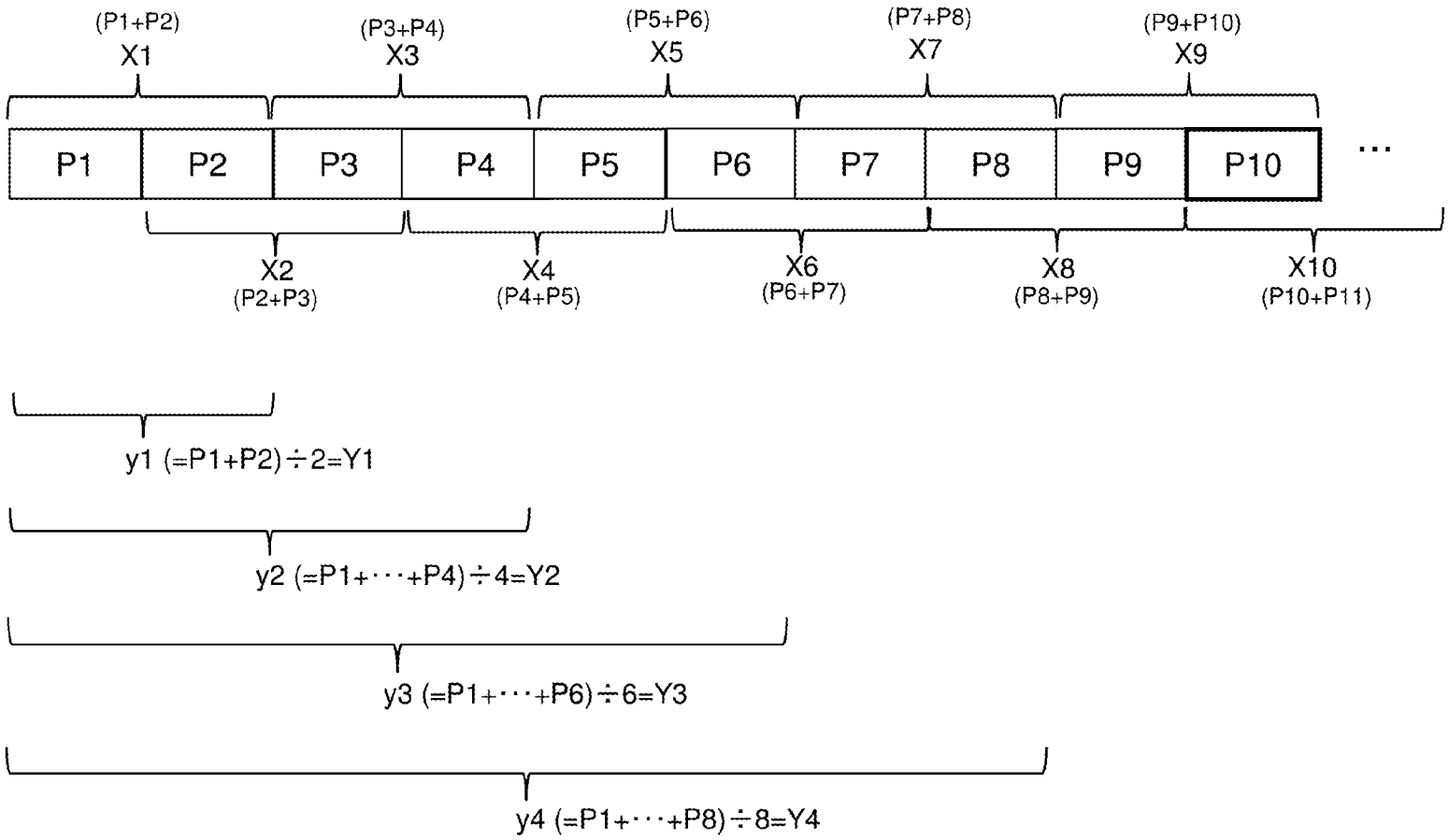

[FIG. 6B]

WHILE NUMBER OF INDEX VALUE DATA IS EQUAL TO OR LESS THAN NUMBER CORRESPONDING TO ONE ROUND OF ENCODER (100 IN THIS EXAMPLE), REMAINING AMOUNT IS CALCULATED BY USING ALL DATA UP TO N-TH DETECTED PIECE.

| N | INDEX VALUE | k | DETERMINATION OBJECT VALUE | AVERAGE VALUE TO BE CALCULATED | REMAINING AMOUNT DISPLAY UPDATE | REMAINING AMOUNT DISPLAY LOCK |
|---|---|---|---|---|---|---|
| 1 | P1 | 1 | - | (NOT CALCULATED) | - | - |
| 2 | P2 | 1 | X1 (=P1+P2) | Y1=average (y1) | O | NO |
| 3 | P3 | 2 | X2 (=P2+P3) | Y1=average (y1) | - | - |
| 4 | P4 | 2 | X3 (=P3+P4) | Y2=average (y2) | O | NO |
| 5 | P5 | 3 | X4 (=P4+P5) | Y2=average (y2) | - | - |
| 6 | P6 | 3 | X5 (=P5+P6) | Y3=average (y3) | O | NO |
| 7 | P7 | 4 | X6 (=P6+P7) | Y3=average (y3) | - | - |
| 8 | P8 | 4 | X7 (=P7+P8) | Y4=average (y4) | O | NO |
| 9 | P9 | 5 | X8 (=P8+P9) | Y4=average (y4) | - | - |
| 10 | P10 | 5 | X9 (=P9+P10) | Y5=average (y5) | O | NO |
| ... | ... | ... | ... | ... | ... | ... |

[FIG. 7]

| RANK | AVERAGE VALUE OF PULSE COUNT INDEX VALUE | REMAINING AMOUNT | DISPLAY EXAMPLE |
|---|---|---|---|
| 1 | 87- | 75 m OR MORE TO LESS THAN 100 m | |
| 2 | 77 - 86 | 50 m OR MORE TO LESS THAN 75 m | |
| 3 | 65 - 76 | 25 m OR MORE TO LESS THAN 50 m | |
| 4 | 57 - 64 | 10 m OR MORE TO LESS THAN 25 m | |
| 5 | 54 - 56 | 5 m OR MORE TO LESS THAN 10 m | |
| 6 | - 53 | LESS THAN 5 m | |

[FIG. 8A]
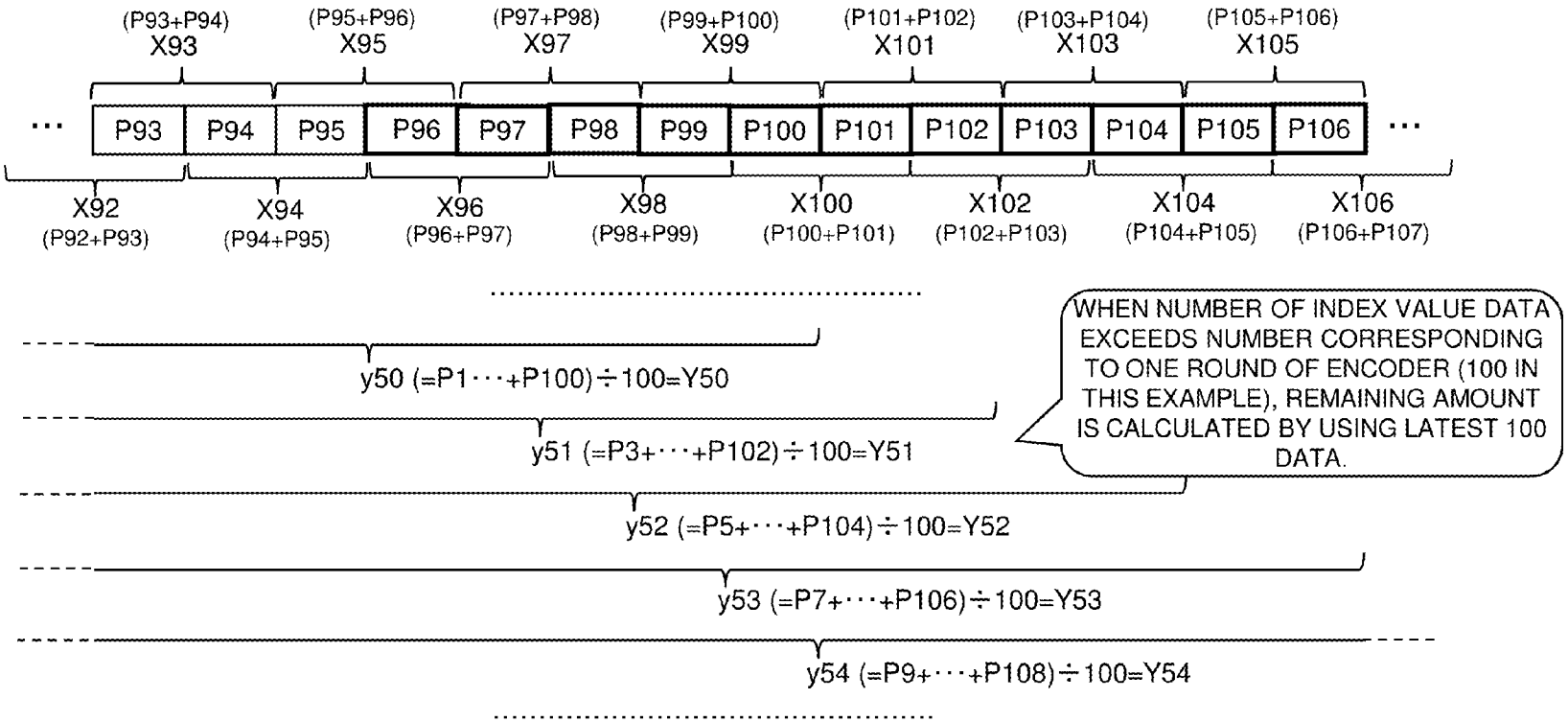

[FIG. 8B]

| N | INDEX VALUE | k | DETERMINATION OBJECT VALUE | AVERAGE VALUE TO BE CALCULATED | REMAINING AMOUNT DISPLAY UPDATE | REMAINING AMOUNT DISPLAY LOCK |
|---|---|---|---|---|---|---|
| ... | ... | ... | ... | ... | ... | ... |
| 100 | P100 | 50 | X99 (=P99+P100) | Y50=average (y50) | ○ | YES |
| 101 | P101 | 51 | X100 (=P100+P101) | Y50=average (y50) | - | - |
| 102 | P102 | 51 | X101 (=P101+P102) | Y51=average (y51) | - | - |
| 103 | P103 | 52 | X102 (=P102+P103) | Y51=average (y51) | - | - |
| 104 | P104 | 52 | X103 (=P103+P104) | Y52=average (y52) | - | - |
| 105 | P105 | 53 | X104 (=P104+P105) | Y52=average (y52) | - | - |
| 106 | P106 | 53 | X105 (=P105+P106) | Y53=average (y53) | - | - |
| ... | ... | ... | ... | ... | ... | ... |

[FIG. 9A]
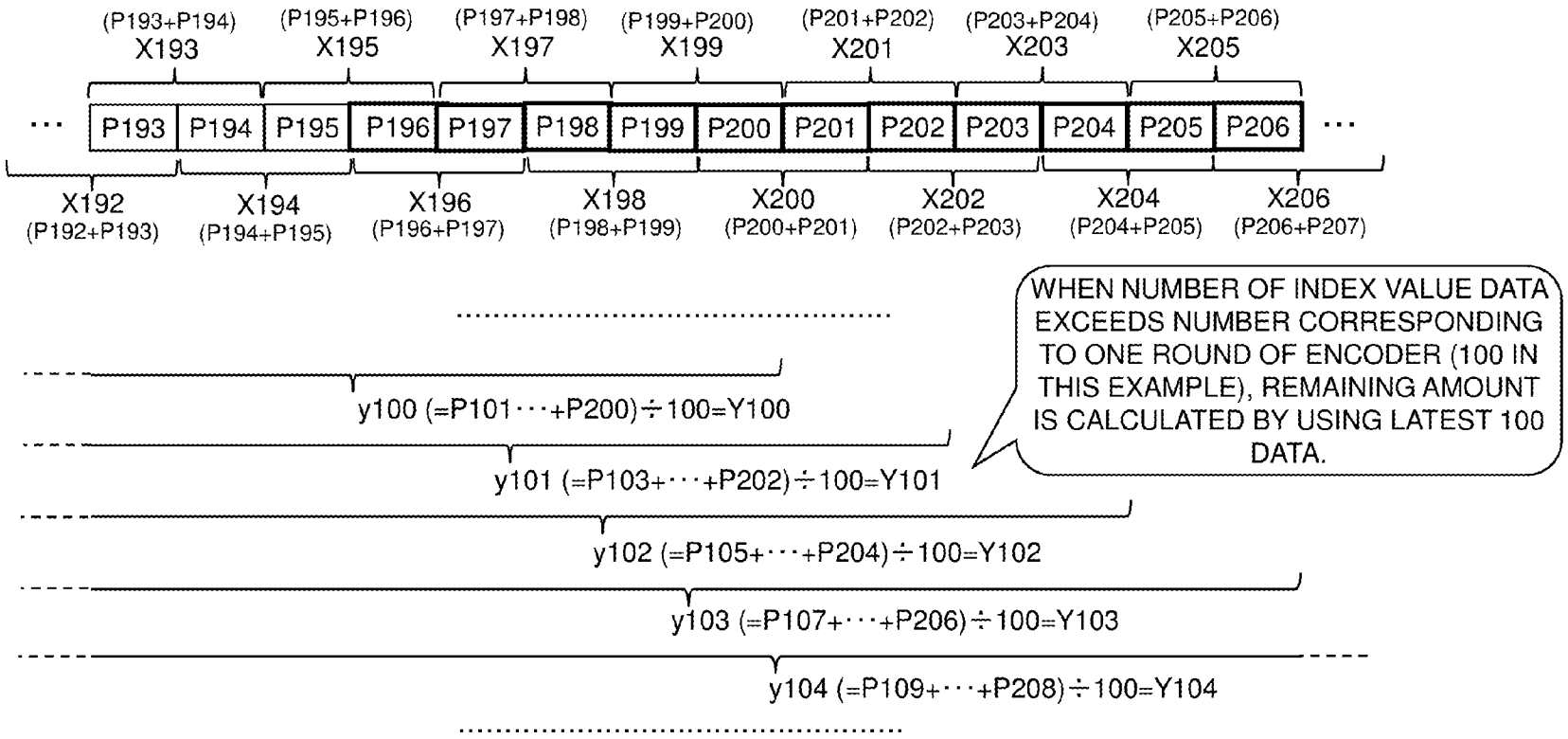

[FIG. 9B]

| N | INDEX VALUE | k | DETERMINATION OBJECT VALUE | AVERAGE VALUE TO BE CALCULATED | REMAINING AMOUNT DISPLAY UPDATE | REMAINING AMOUNT DISPLAY LOCK |
|---|---|---|---|---|---|---|
| ... | ... | ... | ... | ... | ... | ... |
| 200 | P200 | 100 | X199 (=P199+P200) | Y100=average (y100) | O | YES |
| 201 | P201 | 101 | X200 (=P200+P201) | Y100=average (y100) | - | - |
| 202 | P202 | 101 | X201 (=P201+P202) | Y101=average (y101) | - | - |
| 203 | P203 | 102 | X202 (=P202+P203) | Y101=average (y101) | - | - |
| 204 | P204 | 102 | X203 (=P203+P204) | Y102=average (y102) | - | - |
| 205 | P205 | 103 | X204 (=P204+P205) | Y102=average (y102) | - | - |
| 206 | P206 | 103 | X205 (=P205+P206) | Y103=average (y103) | - | - |
| ... | ... | ... | ... | ... | ... | ... |

[FIG. 10]
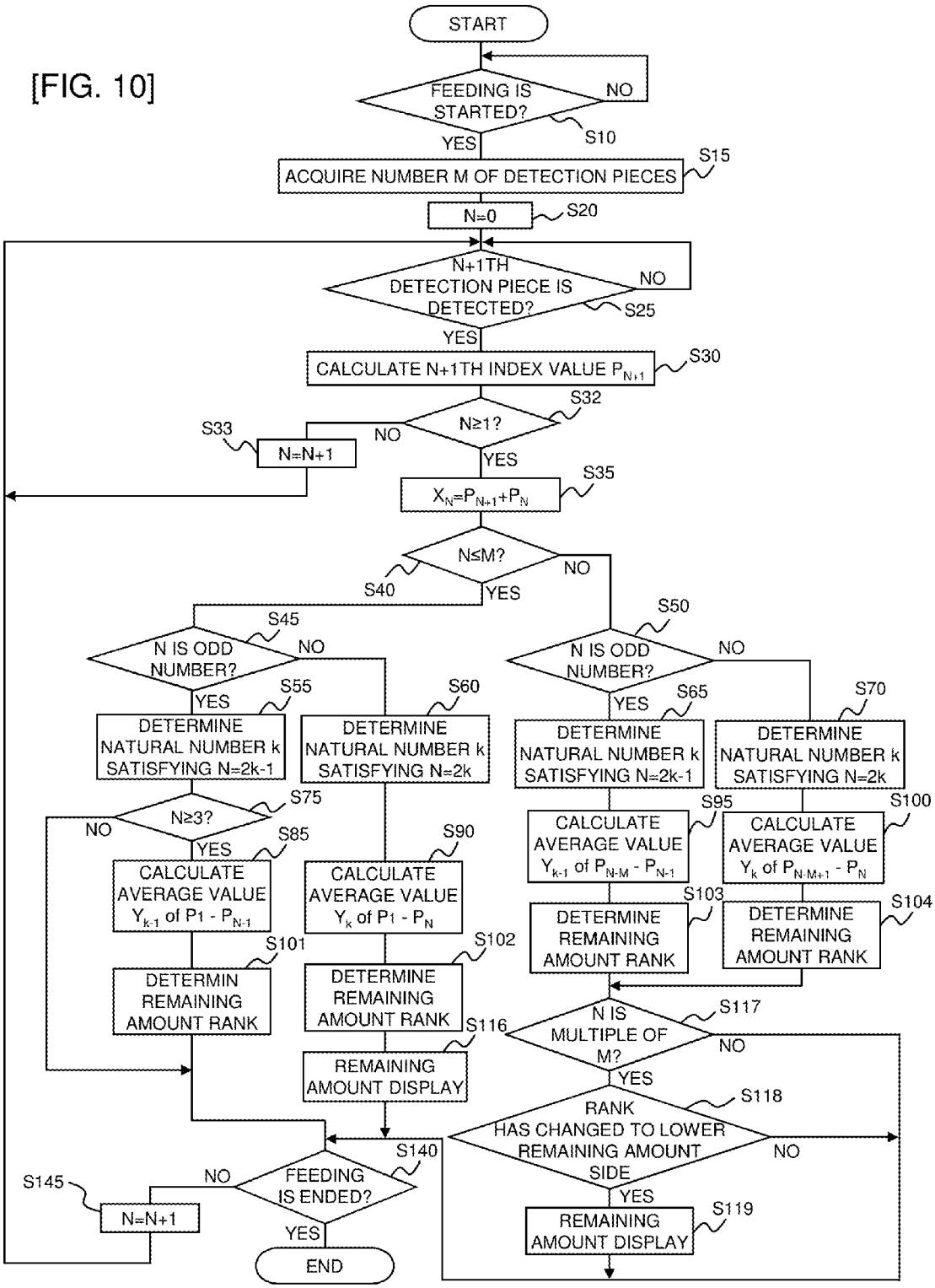

[FIG. 11A]
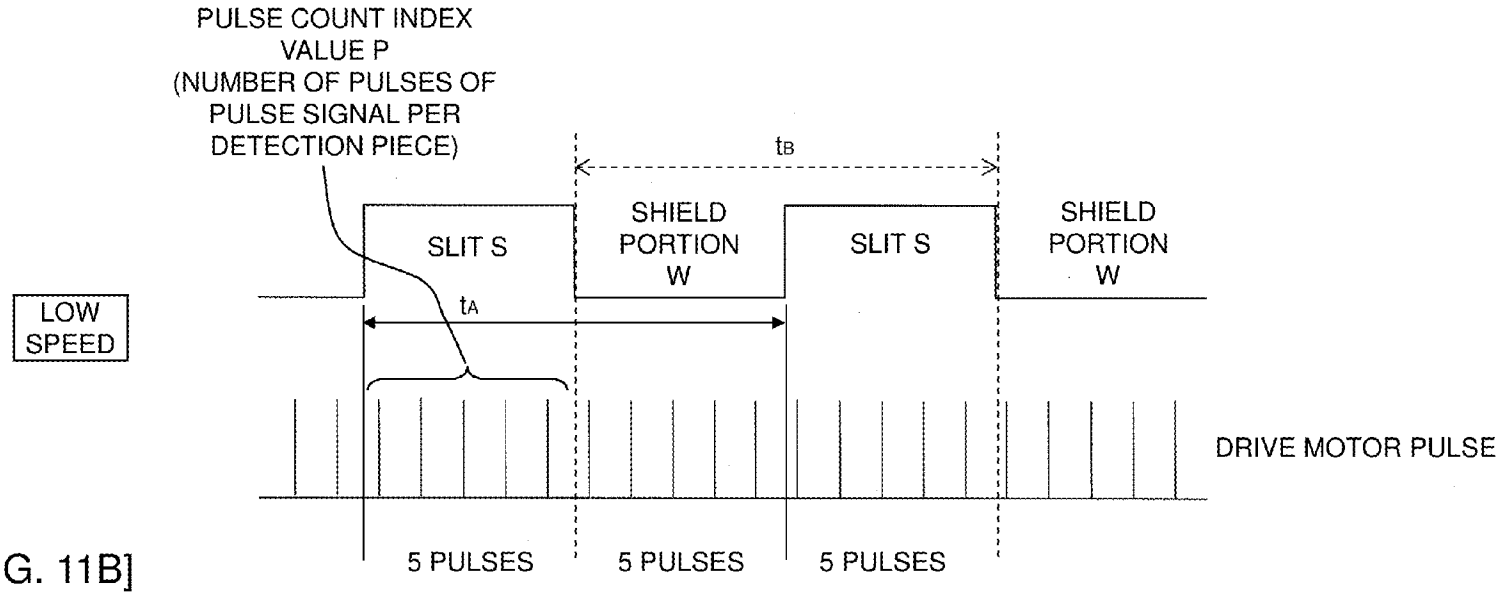
[FIG. 11B]
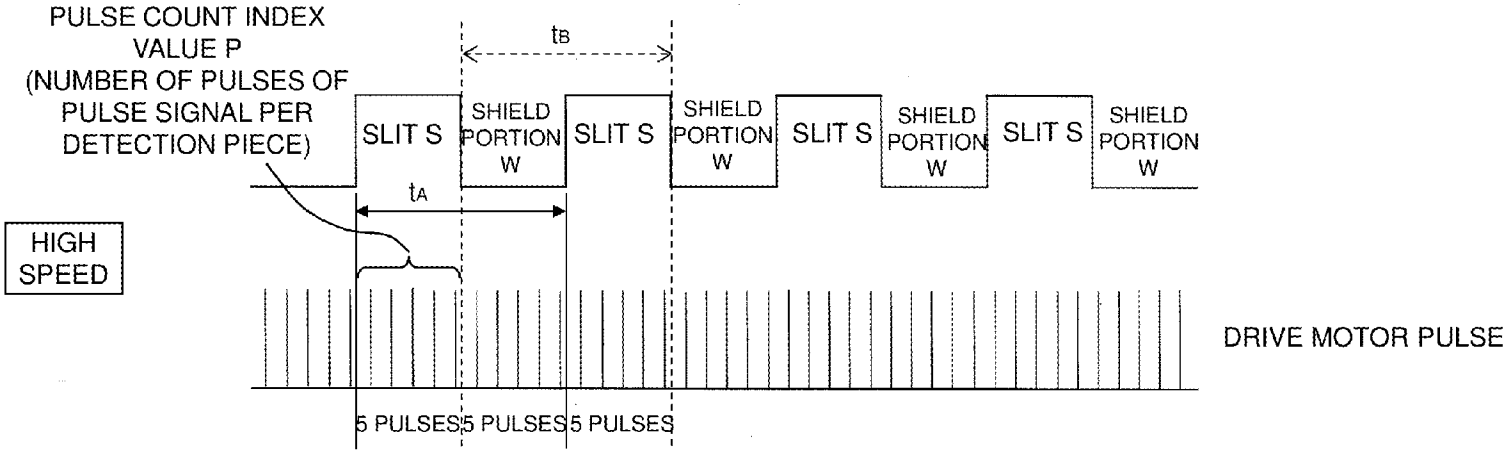

[FIG. 12]
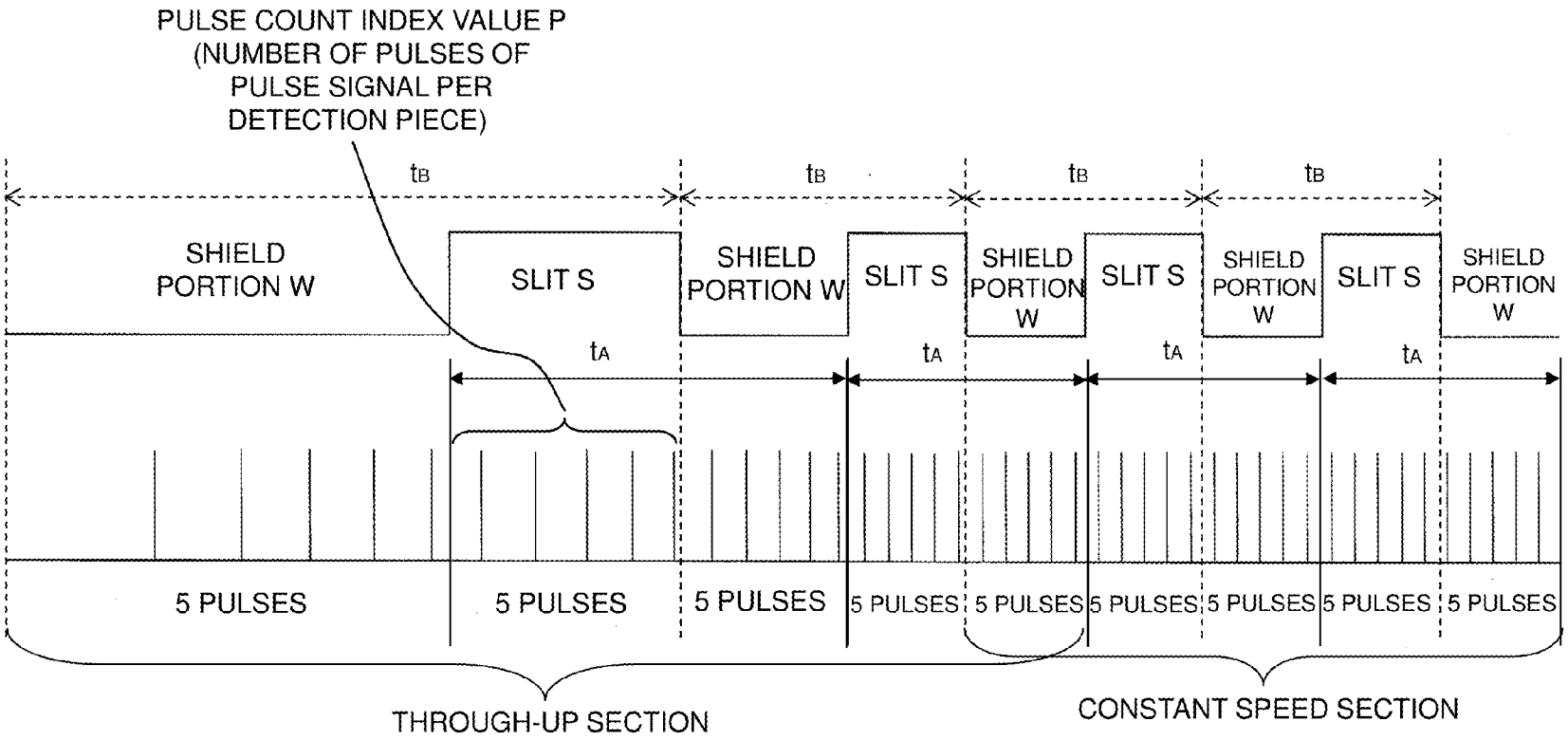

[FIG. 13]
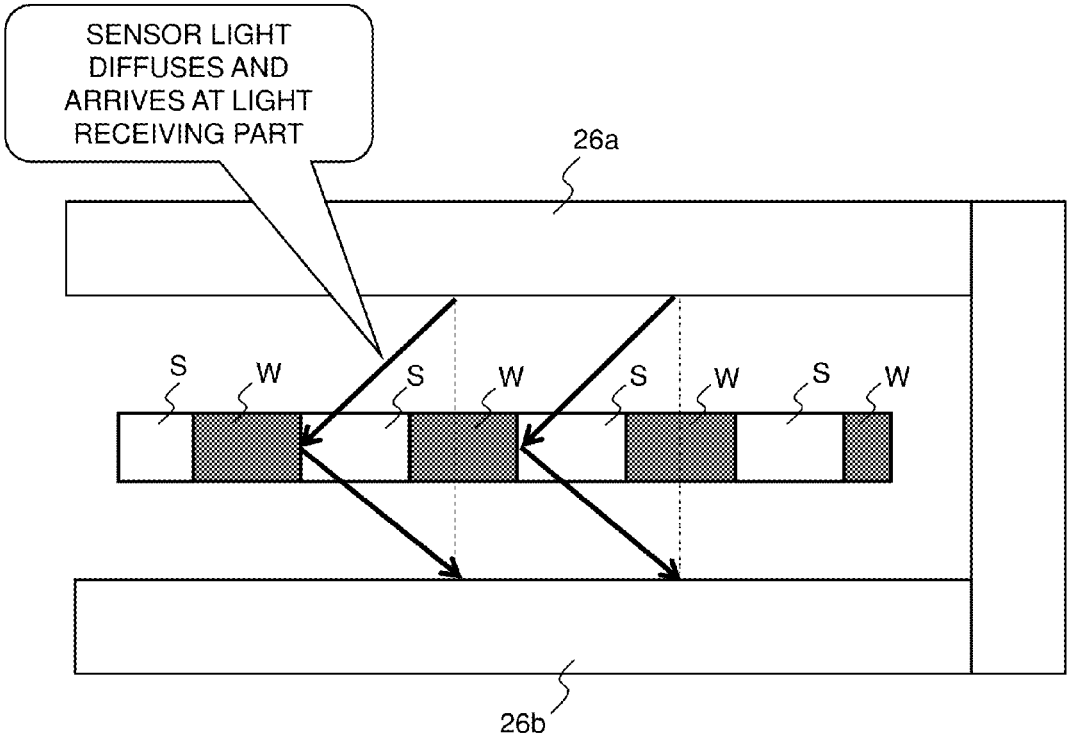

[FIG. 14]
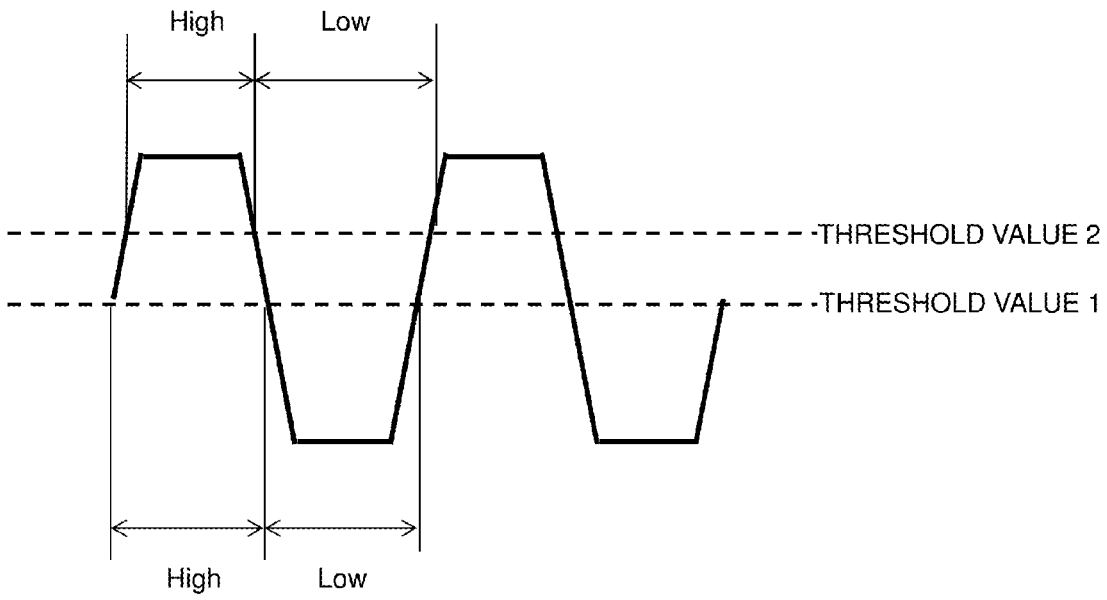

PRINTER

CROSS-REFERENCE TO RELATED APPLICATION

The present application claims priority from Japanese Patent Application No. 2016-71860, which was filed on Mar. 31, 2016, the disclosure of which is incorporated herein by reference in its entirety.

BACKGROUND

Field

The present disclosure relates to a printer performing printing by using an elongated medium.

Description of the Related Art

A printer is known that detects a remaining amount of an elongated medium used and consumed during printing. In this prior art, an object to be detected rotating at the same angular speed as a roll of the wound elongated medium (base tape) is provided in a cartridge housing, and an optical detecting device (optical sensor) optically detects a detection piece provided on the object to be detected. A tape remaining amount is calculated from the angular speed of the roll based on the detection result of the optical detecting device by using a predetermined relational expression calculated in advance. The tape remaining amount is displayed so that an operator can reliably recognize the tape remaining amount.

However, since the remaining amount is detected by using a speed (specifically, the angular speed of the roll of the wound elongated medium) as a parameter in the conventional technique, it is difficult to detect the remaining amount with high accuracy if a feeding speed varies for some reasons such as feeding resistance and environmental condition, or during a so-called through-up operation at the start of feeding and a so-called through-down operation at the time of stopping the feeding. In such a case, the operator becomes unable to clearly recognize an amount of the usable elongated medium and, therefore, a room for improvement exists.

SUMMARY

It is an object of the present disclosure to provide a printer capable of highly accurately determining a remaining amount of an elongated medium independently of a feeding speed and allowing an operator to clearly recognize the amount of the usable elongated medium.

In order to achieve the above-described object, according to an aspect of the present disclosure, there is provided a printer comprising a feeder, a pulse motor, a drive control device, an object to be detected, an optical detection device, a display device, a processor, and a memory. The feeder is configured to feed an elongated medium fed out from a roll with the elongated medium wound around an axis, the elongated medium being consumed during printing. The pulse motor is configured to drive the feeder. The drive control device is configured to output a pulse signal for driving the pulse motor. The object to be detected is configured to rotate in conjunction with a rotation of the roll and includes M detection pieces provided along a circumferential direction, the M being an integer of two or more. The optical detection device is configured to optically detect the detecting pieces of the object to be detected. The display device is configured to perform a desired display. The memory stores computer-executable instructions that, when executed by processor, cause the printer to perform a remaining amount determining process, and an index value detecting process. In the index value detecting process, in accordance with feeding of the elongated medium by the feeder driven by the pulse motor, pulse count index values each represented by the number of pulses of the pulse signal per each of the detection pieces are sequentially detected for the respective detection pieces. In the remaining amount determining process, first process, second process, third process, and fourth process are sequentially executed with N increased by one at a time in accordance with consumption of the elongated medium. In the first process, an Nth determination object value defined as a determination object is calculated from both an Nth pulse count index value after a start of feeding and an N+1th pulse count index value adjacent to the Nth pulse count index, among a plurality of the pulse count index values sequentially detected in the index value detecting process, N being an integer of one or more, In the second process, an average value is calculated from a plurality of successive pulse count index values in a predetermined range including a latest value that is an Nth pulse count index value when N is an even number or is an (N−1)th pulse count index value when N is an odd number of three or more, among a plurality of the pulse count index values sequentially detected in the index value detecting process, In the third process, out of remaining amount ranks preset in multiple stages from a long remaining amount side to a short remaining amount side, the remaining amount rank corresponding to the Nth determination object value is determined based on the average value calculated in the second process by using a predetermined correlation obtained in advance between a remaining amount of the elongated medium in the roll and the pulse count index value. In the fourth process, a rank display corresponding to the remaining amount rank determined in the third process is performed on the displaying device.

In the printer of the present disclosure, an elongated medium wound into a roll is used at the time of performing printing. In particular, a pulse motor drives a feeder based on a pulse signal from a drive control device, and the feeder thereby feeds out and transports the elongated medium from the roll.

In the present disclosure, an object to be detected and an optical detection device are provided so as to detect a remaining amount in the roll of the elongated medium fed out as described above and sequentially consumed (in other words, a consumed amount of the elongated medium. the same applies hereinafter). The object to be detected comprises M detection pieces (M is an integer of two or more) at a predetermined intervals in the circumferential direction and rotates in conjunction with the rotation of the roll due to the feeding of the elongated medium. The detection pieces provided on the object to be detected are detected by the optical detection device because of the rotation of the object to be detected, and a pulse count index value (=the number of pulses of a pulse signal per detection piece) is sequentially detected in an index value detecting process. As the elongated medium is more consumed (the remaining amount becomes smaller), the diameter of the roll becomes smaller and the angular speed of the object to be detected rotating due to the feeding becomes faster, so that the pulse count index value consequently gradually decreases. In the present disclosure, a remaining amount determining process is executed in accordance with this behavior, and the pulse count index value is used for determining the remaining amount of the elongated medium and performing display corresponding thereto.

In particular, in the second process after determining the Nth determination object value defined as a determination object in the first process, an average value is calculated from a plurality of successive pulse count index values in a predetermined rage in which the latest value is the Nth pulse count index value (or (N−1)th pulse count index value) from the start of feeding. In this case, a predetermined correlation is obtained in advance between the remaining amount of the elongated medium and the pulse count index value (e.g., by actual measurement or as a theoretical value) and, in the third process, the correlation is applied to the calculated average value so that the remaining amount of the actual elongated medium in the roll at a given point in time can be determined. In the present disclosure, the remaining amount rank is set in advance in multiple stages from the long remaining amount side to the short remaining amount side and, in the third process, the correlation is applied to the average value so as to directly determine the remaining amount rank corresponding to the Nth determination object value (without specifically calculating the value of the remaining amount of the elongated medium). As a result, in the subsequent fourth process, the rank display corresponding to the remaining amount rank is performed.

In the above description, when a pulse signal of one pulse is applied to the pulse motor to rotate the pulse motor, the rotation amount is constant independently of the rotation speed. Since the present disclosure provides a technique using the pulse count index value (=the number of pulses of a pulse signal per detection piece) as described above, the remaining amount of the elongated medium can be determined independently of a magnitude of the feeding speed of the feeder at a given point in time. Consequently, as compared to the conventional technique of detecting the remaining amount by using a speed (specifically, an angular speed of a roll of a wound elongated medium) as a parameter, the remaining amount of the elongated medium can highly accurately and highly reliably be determined, and the corresponding rank display can be performed. Additionally, being independent of the feeding speed produces an advantage that the remaining amount can highly accurately be determined even during a so-called through-up operation at the start of feeding and a so-called through-down operation at the time of stopping the feeding. Moreover, the remaining amount can therefore reliably be determined even in the case of production of a very short printed matter printed substantially only by the through-up/through-down operations.

As a result, according to the present disclosure, an amount of the usable elongated medium can visually clearly be recognized by an operator, so that the convenience for the operator can be improved.

BRIEF DESCRIPTION OF THE DRAWINGS

FIG. 1 is a perspective view of an exterior appearance configuration of a printer of an embodiment of the present disclosure.

FIG. 2 is a plane view of an internal configuration of the printer.

FIG. 3A is a partially enlarged side cross-sectional view when a ribbon cassette is mounted on a cassette storage part of the printer.

FIG. 3B is a plane view of an encoder plate.

FIG. 4 is a functional block diagram of a control system of the printer.

FIG. 5A is an explanatory diagram of an example of a pulse count index value.

FIG. 5B is an explanatory diagram of an example of the pulse count index value.

FIG. 6A is an explanatory diagram for explaining contents of a calculation process by a CPU until the encoder plate rotates once.

FIG. 6B is an explanatory diagram for explaining contents of the calculation process by the CPU until the encoder plate rotates once.

FIG. 7 is a table showing correlation between a remaining amount of the ink ribbon and the pulse count index value.

FIG. 8A is an explanatory diagram for explaining contents of a calculation process by the CPU until the encoder plate rotates twice after having rotated once.

FIG. 8B is an explanatory diagram for explaining contents of the calculation process by the CPU until the encoder plate rotates twice after having rotated once.

FIG. 9A is an explanatory diagram for explaining contents of a calculation process by the CPU after the encoder plate has rotated twice.

FIG. 9B is an explanatory diagram for explaining contents of the calculation process by the CPU after the encoder plate has rotated twice.

FIG. 10 is a flowchart of control procedures executed by the CPU of the printer.

FIG. 11A is an explanatory diagram of an example of a behavior of the pulse count index value at a low speed.

FIG. 11B is an explanatory diagram of an example of a behavior of the pulse count index value at a high speed.

FIG. 12 is an explanatory diagram of an example of a behavior of the pulse count index value at the time of through-up.

FIG. 13 is an explanatory diagram of an influence of a roundabout phenomenon of photosensor light.

FIG. 14 is an explanatory diagram of a time width of a detection pulse according to a magnitude relationship between a threshold value set at the time of optical detection and a signal value.

DETAILED DESCRIPTION OF THE PREFERRED EMBODIMENTS

An embodiment of the present disclosure will now be described with reference to the drawings.

<Overall General Configuration>

An overall general configuration of a printer of this embodiment will be described with reference to FIGS. 1 and 2. In the following description, the upper, lower, lower right, upper left, upper right, and lower left sides of FIG. 1 are respectively defined as the upper, lower, front, rear, right, and left directions of the printer.

In FIGS. 1 and 2, a printer 1 is a device comprising two printing mechanisms and capable of printing on both a tape (not shown) that is a belt-shaped print-receiving medium and a tube 9 that is a tubular print-receiving medium. A configuration for printing the tape is not shown in the figures, and a configuration for printing on the tube 9 will hereinafter mainly be described.

The printer 1 comprises a housing 10 including a main body case 11 and a cover 12. The main body case 11 is a rectangular parallelepiped box-shaped member elongated in the left-right direction. The cover 12 is a plate-shaped member located on the upper side of the main body case 11. A rear end portion of the cover 12 is rotatably supported on the upper side of a rear end portion of the main body case 11. The cover 12 pivots such that a front end portion moves upward and downward, thereby opening and closing a mounting surface 11A that is an upper surface of the main body case 11. A locking mechanism 13 is provided on the upper side of the front end portion of the main body case 11. When the cover 12 is closed with respect to the main body case 11, the locking mechanism 13 locks the front end portion of the cover 12 and restricts the opening.

When the cover 12 is closed with respect to the main body case 11 (see FIG. 1), the cover 12 covers the mounting surface 11A. When opening the cover 12, a user (an operator) operates the lock mechanism 13 to release the locking of the cover 12 and cause the cover 12 to pivot upward from the locking mechanism 13. When the cover 12 is opened with respect to the main body case 11 (not shown), the mounting surface 11A is exposed upward.

An operation part 17, a tube inserting port 15, and a tube discharging exit 16 are provided on side surfaces of the housing 10. The operation part 17 has a plurality of operation buttons including a power button and a start button. The operation part 17 is provided on an upper portion on the right side of the front surface of the main body case 11. The tube inserting port 15 is an opening for guiding the tube 9 into the housing 10. The tube inserting port 15 is provided on an upper portion on the rear side of the right surface of the main body case 11 and has a rectangular shape slightly elongated in the up-down direction. The tube discharging exit 16 is an opening for discharging the tube 9 to the outside of the housing 10. The tube discharging exit 16 is provided on an upper portion on the rear side of the left surface of the main body case 11 and has a rectangular shape slightly elongated in the up-down direction. The tube discharging exit 16 is slightly on the front side relative to the tube inserting port 15.

The mounting surface 11A is disposed with a ribbon cassette mounting part 30 and a tube mounting part 40.

The cover 12 is disposed with a remaining amount display part 500 (see also FIG. 4 described later) for displaying a remaining amount of an ink ribbon 93 described later.

The ribbon mounting part 30 is a position at which a ribbon cassette 95 can be attached and detached. The ribbon mounting part 30 is a recess opened upward, and is formed in an opening shape substantially corresponding to the ribbon cassette 95 in a plan view. In the example, the ribbon cassette mounting part 30 is provided on a left portion of the mounting surface 11A and on the front side of the tube mounting part 40.

The ribbon cassette 95 is a box-shaped body containing an ink ribbon 93. In the ribbon cassette 95, a ribbon spool 56 of a ribbon roll R1 and a ribbon take-up shaft 63 having the used ink ribbon 93 wound therearound are each rotatably supported. The ribbon roll R1 includes the unused ink ribbon 93 wound around the ribbon spool 56.

In this state, as shown in FIG. 3 (see also FIG. 2), the ribbon spool 56 is rotatably supported by a cassette boss 43 vertically extending from the bottom surface of the ribbon cassette 95. On the other hand, a disk-shaped ribbon gear 32 having the same central axis as the ribbon spool 56 is provided between the ribbon roll R1 and an upper surface of the ribbon cassette 95. The ribbon gear 32 is coupled to an upper end portion of the ribbon spool 56 and the ribbon gear 32 rotates integrally with the ribbon spool 56 when the tube 9 is transported by drive of a drive motor 103 (see FIG. 4 described later) that is a pulse motor.

A spool gear 33 meshing with the ribbon gear 32 is rotatably provided in the ribbon cassette 95. The spool gear 33 has a substantially cylindrical shape and has a plurality of teeth meshing with the ribbon gear 32 on the outer circumference of the upper end portion. The spool gear 33 has a tip diameter smaller than that of the ribbon gear 32 (see FIG. 2). In a planar view, the spool gear 33 is positioned closer to a wall surface of the ribbon cassette 95 relative to the line connecting the center of the ribbon spool 56 and the center of the ribbon take-up shaft 63, and has the root circle and the rotation center located within a gap region defined by an outer circumference circle of the ribbon roll R1 at the start of use, an outer circumference circle of the ink ribbon 93 at the end of use, and the inner side wall surface of the ribbon cassette 95. On the other hand, the tip diameter of the ribbon gear 32 is equal to or greater than a roll diameter of the ribbon roll R1 at the start of use.

In this positional relationship between the ribbon gear 32 and the spool gear 33, the ribbon gear 32 is considerably larger than the gear 33 and the gear ratio of the two gears is also large. In this embodiment, the ratio of the numbers of teeth between the ribbon gear 32 and the spool gear 33 is 50:16, for example. Therefore, when the ink ribbon 93 is transported by the drive of the drive motor 103, the spool gear 33 rotates at a high speed that is several times (e.g., about three times) as fast as the rotation speed of the ribbon gear 32. The spool gear 33 has a concave-convex portion on the upper portion of the inner wall, thereby engaging with a cam member 76 described later.

On the other hand, a rotating shaft 35 is provided on the ribbon cassette mounting part 30. As shown in FIG. 3A, the rotating shaft 35 vertically extends from a basal plate 65 located under a bottom plate 47 of the ribbon cassette mounting part 30 and in the vicinity of the side surface on the rear side of the ribbon cassette mounting part 30 (a left front portion of FIG. 2). A cylindrical cam member 76 is rotatably mounted on the rotating shaft 35 with the rotating shaft 35 defined as an axis. When the ribbon cassette 95 is mounted on the ribbon cassette mounting part 30, three blade-like projections provided on an outer side surface of the cam member 76 are fitted to the concave-convex portion of the inner wall of the spool gear 33 so that the cam member 76 is engaged with the spool gear 33. Between the bottom plate 47 of the ribbon cassette mounting part 30 and the basal plate 65, a disk-shaped encoder plate 25 (see FIG. 3B) is coupled to a lower end portion of the cam member 76 such that the rotating shaft 35 is defined as an axis. Therefore, when the ribbon cassette 95 is mounted on the ribbon cassette mounting part 30 and the ink ribbon 93 is pulled out from the ribbon roll R1 by the drive of the drive motor 103, the encoder plate 25 rotates integrally with the spool gear 33 and the cam member 76 at a high speed that is several times (about three times in this example) as fast as the rotation speed of the ribbon gear 32.

The outer diameter of the encoder plate 25 is larger than the addendum circle of the spool gear 33. The encoder plate 25 is provided below the bottom surface of the ribbon cassette mounting part 30 outside the ribbon cassette 95 and therefore can be disposed as a plate having a significantly large diameter, so that a plurality of (in the shown example, 32) slits S can be provided at predetermined intervals along the circumferential direction of the encoder plate 25 (see FIG. 3B). Portions between the slits S function as shield portions W not allowing passage of light. The M slits S and the M shield portions W function as detection pieces optically detected by a photosensor 26 described later (hereinafter referred to as detection pieces S, W as appropriate). Therefore, the encoder plate 25 is disposed with the M detection pieces S, W (M is an integer of two or more: M=64 in this example) that are twice as large as the number of the slits.

The photosensor 26 including a light transmissive sensor etc. is provided to a position facing the slits S and the shield portions W of the encoder plate 25. Although not shown, the photosensor 26 is fixedly provided on the basal plate 65 and comprises a light emitting portion 26*a* and a light receiving portion 26*b* (see FIG. 13 described later). As described later, the photosensor 26 is connected to an input/output interface (I/F) 195 of a control circuit 190 (see FIG. 4 described later), and outputs a pulse signal (detection pulse) as a detection signal corresponding to the slits S and the shield portions W when the encoder plate 25 rotates (see FIG. 5 described later).

Returning to FIG. 2, the tube mounting part 40 is a position at which the tube 9 can be attached and detached. The tube mounting part 40 is a groove opened upward and extends from the tube inserting port 15 to the tube discharging exit 16. Since the tube discharging exit 16 is slightly on the front side relative to the tube inserting port 15, the tube mounting part 40 extends substantially in the left-right direction with a slight inclination toward the left front side. A rear end portion of the ribbon cassette mounting part 30 is spatially connected to the tube mounting part 40 on the right side of the tube discharging exit 16. A groove width of the tube mounting part 40 is slightly larger than the outer diameter of the tube 9 except a position at which the tube mounting part 40 and the ribbon cassette mounting part 30 are spatially connected. The user can mount the tube 9 onto the tube mounting part 40 from above while the cover 12 is opened. In this case, the user mounts the tube 9 on the tube mounting part 40 such that the tube 9 extends from the tube inserting port 15 to a predetermined pressure position. The tube 9 mounted on the tube mounting part 40 is transported through a tube transport path 40*a* (hereinafter simply referred to as the "transport path 40*a*" as appropriate) along the tube mounting part 40 by a platen roller 62, pressure transport rollers 66, and pressure transport rollers 67 described later. An extending direction of the conveying path 40 will hereinafter be referred to as a tube transport direction (hereinafter simply referred to as the "transport direction" as appropriate).

The printer 1 comprises a control board 19, a power source part 18 (see FIG. 4 described later), a tube printing mechanism 60, etc.

The control board 19 is a board disposed with the control circuit 190 described later (see FIG. 4 described later) etc. In this example, the control board 19 is provided on a right rear portion inside the main body case 11.

The tube printing mechanism 60 includes a printing head 61, the platen roller 62, a pair of the pressure transport rollers 66, a pair of the pressure transport rollers 67, the ribbon take-up shaft 63, the drive motor 103 (see FIG. 4 described later), a cutter 64, a blade receiving plate 165, a cutter motor 105 (see FIG. 4 described later), etc. The platen roller 62, the pressure transport rollers 66, and the pressure transport rollers 67 will hereinafter collectively be referred to as the "platen roller 62 etc." as appropriate.

The printing head 61 and the ribbon take-up shaft 63 each vertically extend upward from the bottom surface of the ribbon cassette mounting part 30. The printing head 61 is a thermal head comprising a plurality of heat generators (not shown) provided on the rear portion of the ribbon cassette mounting part 30. The printing head 61 forms a print by using the ink ribbon 93 on the tube 9 transported by the platen roller 62 etc. and interposed between the printing head 61 and the platen roller 62. The ribbon take-up shaft 63 is a shaft capable of rotating a ribbon take-up spool 92. When the ribbon cassette 95 is mounted on the ribbon cassette mounting part 30, the ribbon take-up shaft 63 is fitted to the ribbon take-up spool 92.

On the rear side of the ribbon cassette mounting part 30, the platen roller 62 is arranged to face the printing head 61 along the direction orthogonal to the conveying direction. The platen roller 62 presses the tube 9 in the tube mounting part 40 and the unused ink ribbon of the ribbon cassette 95 overlapped each other and interposed between the plat head roller 62 and the printing head 61 toward the printing head 61 and transports the tube 9 along the transport path 40 while flattening and bringing the tube 9 into surface contact with the printing head 61 via the ink ribbon 93. The pressure transport rollers 66 making a pair are arranged to face each other along a direction orthogonal to the transport direction on the tube inserting port 15 side (hereinafter simply referred to as the "upstream side" as appropriate) relative to the printing head 61 along the transport path 40*a*. The pair of the pressure transport rollers 66 transports the interposed tube 9 in the tube mounting part 40 along the transport path 40*a* while pressing and flattening the tube 9. The pressure transport rollers 67 making a pair are arranged to face each other along a direction orthogonal to the transport direction on the tube discharge exit 16 side (hereinafter simply referred to as the "downstream side" as appropriate) at a predetermined distance from the printing head 61 along the transport path 40*a* and on the upstream side relative to an optical sensor 69 (see FIG. 4 described later). The pair of the pressure transport rollers 67 transports the interposed tube 9 in the tube mounting part 40 along the transport path 40*a* while pressing and flattening the tube 9.

The platen roller 62, one of the pressure transport rollers 66, and one of the pressure transport rollers 67 can be displaced to an actuated position and a retracted position in accordance with opening and closing of the cover 12. In particular, when the cover 12 is opened, the platen roller 62, the one pressure transport rollers 66, and the one pressure transport rollers 67 are displaced to the retracted position. When the platen roller 62, the one pressure transport rollers 66, and the one pressure transport rollers 67 are at the retracted position (not shown), the platen roller 62, the one pressure transport rollers 66, and the one pressure transport rollers 67 are arranged outside the tube mounting part 40 and separated away from the printing head 61, the other pressure transport roller 66, and the other pressure transport roller 67, respectively. On the other hand, when the cover 12 is closed, the platen roller 62, the one pressure transport roller 66, and the one pressure transport roller 67 are displaced to the actuated position. When the platen roller 62, the one pressure transport roller 66, and the one pressure transport roller 67 are at the actuated position (see FIG. 2), the platen roller 62, the one pressure transport roller 66, and the one pressure transport roller 67 are arranged inside the tube mounting part 40 and brought close to the printing head 61, the other pressure transport roller 66, and the other pressure transport roller 67, respectively.

The drive motor 103 outputs a drive force for rotating the platen roller 62, the pressure transport roller 66, the pressure transport roller 67, and the ribbon take-up shaft 63. The drive force of the drive motor 103 is transmitted through a predetermined transmission mechanism to the platen roller 62, the pressure transport rollers 66, the pressure transport rollers 67, and the ribbon take-up shaft 63 so that the platen roller 62, the pressure transport rollers 66, the pressure transport rollers 67, and the ribbon take-up shaft 63 rotate in synchronization with each other.

The cutter 64 and the blade receiving plate 165 are arranged to face each other with the transport path 40*a* interposed therebetween on the downstream side relative to the printing head 61. The cutter 64 moves toward the blade receiving plate 165 and presses the tube 9 in the tube mounting part 40 against the blade receiving plate 165 to cut the tube 9 so that a tube portion located on the downstream side of the cutting position is separated.

The cutter motor 105 outputs a drive force for actuating the cutter 64.

A mechanical sensor 68 is provided on the transport path 40*a* on the upstream side relative to the pressure transport rollers 66. The mechanical sensor 68 mechanically detects the presence/absence of the tube 9 and outputs a corresponding detection signal. For example, the mechanical sensor 68 detects the presence of the tube 9 from collapsing of a collapsible detection piece vertically extending on the transport path 40*a* and outputs the detection signal.

The optical sensor 69 is provided in the main body case 11 on the downstream side relative to the pressure transport rollers 67 and on the upstream side relative to the cutter 64. The optical sensor 69 is a light transmissive optical sensor comprising a light projecting part 691 and a light receiving part 962, for example (see FIG. 4 described later for both parts).

<Control System>

A control system of the printer 1 will be described with reference to FIG. 4.

In FIG. 4, as described above, a control circuit 190 is provided on the control board 19 of the printer 1. A CPU 191 acting as a processor is provided on the control circuit 190 and the CPU 191 is connected to a ROM 192 acting as a recording medium, a memory 193, a RAM 194, and an input/output interface 195 through a data bus.

The ROM 192 stores various programs (including a control program for executing procedures of a flowchart shown in FIG. 10 described later) necessary for controlling the printer 1. The CPU 191 executes a signal process in accordance with a program stored in the ROM 192 while utilizing a temporary storage function of the RAM 194, thereby carrying out overall control of the printer 1.

The memory 193 includes a portion of a storage area of the ROM 192 or an EEPROM (not shown), for example. The memory 193 stores in advance a table (see FIG. 7 described later) for displaying a remaining amount (consumed amount) of the ink ribbon 93 on the remaining amount display part 500 described later.

The input/output interface 195 is connected to drive circuits 101, 102, 104, the operation part 17, the power source part 18, the photosensor 26, the mechanical sensor 68, the light projecting part 691 and the light receiving part 692 of the optical sensor 69, the remaining amount display part 500, etc.

The drive circuit 101 carries out energization control of a plurality of the heat generators of the printing head 61. The drive circuit 102 outputs a drive pulse to the drive motor 103 rotationally driving the platen roller 62, the ribbon take-up shaft 63, and the pressure transport rollers 66, 67, thereby carrying out drive control. The drive circuit 104 carries out drive control of the cutter motor 105 driving the cutter 64.

The power source part 18 is connected to a battery (not shown) mounted inside the main body case 11, or is connected to an external power source (not shown) through a cord, to supply power to the printer 1.

The remaining amount display part 500 displays a remaining amount of the ink ribbon 93 corresponding to a result of the detection by the photosensor 26 (described in detail later).

<Outline of Printing Tube Producing Operation>

After the ribbon cassette 95 is mounted on the ribbon cassette mounting part 30 and the tube 9 is mounted on the tube mounting part 40 in the printer 1 having the configuration described above, when the cover 12 is closed and the platen roller 62, the one pressure transport roller 66, and the one pressure transport roller 67 are displaced from the retracted position to the actuated position, the tube 9 and the ink ribbon 93 are interposed between the printing head 61 and the platen roller 62, and the tube 9 is interposed between the pressure transport rollers 66 making a pair and between the pressure transport rollers 67 making a pair.

The driving force of the drive motor 103 causes the platen roller 62, the pressure transport rollers 66, the pressure transport rollers 67, and the ribbon take-up shaft 63 to rotate in synchronization with each other. The tube 9 is transported to the downstream side in accordance with the rotation of the platen roller 62, the pressure transport rollers 66, and the pressure transport rollers 67, and the ribbon take-up spool 92 rotates in accordance with the rotation of the ribbon take-up shaft 63, so that the ink ribbon 93 is pulled out from the ribbon roll R1. In this state, a plurality of heat generators of the printing head 61 is energized by the drive circuit 101 to generate heat, and the front surface of the tube 9 comes into surface contact with the printing head 61 via the ink ribbon 93. As a result, the printing head 61 performs a print of print data such as characters, marks, and graphics on the front surface of the tube 9. The used ink ribbon 93 is taken up by the ribbon take-up spool 92.

Subsequently, the tube 9 is further transported to the downstream side and discharged from the housing 10 through the tube discharging exit 16. In this case, when a cut position of the tube 9 is transported to the cutting position, the cutter 64 is actuated by the drive force of the cutter motor 105 to cut the tube 9 at the cut position so that a tube portion located on the downstream side relative to the cutting position and having the print data formed thereon is separated as a print tube.

Feature of Embodiment

A feature of this embodiment is a technique of using a pulse count index value (described later) to rapidly and accurately detect and display a remaining amount of the ink ribbon 93 (in other words, a consumed amount of the ink ribbon 93. the same applies hereinafter) in the ribbon roll R1. The details thereof will hereinafter be described.

<Optical Detection for Encoder Plate>

As described above, when printing is performed onto the tube 9, the ribbon take-up shaft 63 is driven by the drive motor 103 that is a pulse motor based on the drive pulse from the drive circuit 102 so as to feed out and transport the ink ribbon 93 rolled into the ribbon roll R1. In this case, the encoder plate 25 rotates in conjunction with the rotation of the ribbon roll R1 due to the transport of the ink ribbon 93 because of the configuration described above.

In an example shown in FIG. 5A, during the drive of the drive motor 103 and the rotation of the encoder plate 25 performed in conjunction with each other as described above, one of the slits S is detected by the photosensor 26 due to the rotation of the encoder plate 25 while seven pulses are output as the drive pulses (described as "drive motor pulse" in the figures), and one of the shield portions W is detected by the photosensor 26 due to the rotation of the encoder plate 25 while six pulses are output as the drive pulses. Therefore, in terms of the detection pieces S, W as a whole, one of the detection pieces S, W is detected by the photosensor 26 while 6.5 pulses are output as the drive pulses.

On the other hand, as the ink ribbon 93 is more consumed, the diameter of the ribbon roll R1 becomes smaller and the angular speed of the encoder plate 25 rotating because of feeding becomes faster. Therefore, when the ink ribbon 93 is further consumed from the state shown in FIG. 5A, one of the slits S is detected by the photosensor 26 due to the rotation of the encoder plate 25 while five pulses are output as the drive pulses, and one of the shield portions W is detected by the photosensor 26 due to the rotation of the encoder plate 25 while four pulses are output as the drive pulses, as shown in FIG. 5B, for example. Therefore, in terms of the detection pieces S, W as a whole, one of the detection pieces S, W is detected by the photosensor 26 while 4.5 pulses are output as the drive pulses.

In this embodiment, focusing on the relationship as described above, a process is executed by using the number of pulses of the drive pulse per detection piece S, W (hereinafter referred to as a "pulse count index value" as appropriate) as an index value for detecting the remaining amount (in other words, the consumed amount as described above) of the ink ribbon 93 fed out and transported as described above. For example, the pulse count index value is 6.5 in the example shown in FIG. 5A and the pulse count index value is 4.5 in the example shown in FIG. 5B. In this way, as the ink ribbon 93 is consumed, the pulse count index value gradually decreases. The remaining amount is at least detectable based on such a behavior.

<Calculation Contents>

However, in this embodiment, the CPU 191 executes a more elaborate calculation process so as to detect the remaining amount more quickly with higher accuracy. The contents of the process are divided into three states, i.e., a state shortly after the start of feeding (specifically, until the encoder plate 25 rotates once after the start of rotation) and states in which a certain amount of time has elapsed after the start of feeding (specifically, after the encoder plate 25 has rotated once and after the encoder plate 25 has rotated twice), each of which will be described. In the case taken as a schematic example described below with reference to FIGS. 6A, 6B, 8A, 8B, 9A, and 9B, for simplicity of description, only 100 detection pieces S, W (50 slits S and 50 shield portions W, i.e., M=50) are provided on the encoder plate 25. Additionally, the term "after the start of feeding" refers not only to the case that the new ribbon cassette 95 is mounted to feed and start using the unused ink ribbon 93, but also the case that the ribbon cassette 95 already started being used is mounted to newly perform a print onto the tube 9. Therefore, the term has the same meaning as "after starting a printing process."

<Until Encoder Plate Rotates Once>

In this embodiment, as described above, after the start of feeding, the pulse count index value P is sequentially calculated each time one of the detection pieces S, W is detected and the remaining amount is determined based on the behavior of the value. Specifically, the sum of the latest pulse count index value P and the previous pulse count index value P is defined as a determination object value, and an average value of all the past pulse count index value data already calculated is correspondingly calculated.

For example, when a first one of the detection pieces S, W is detected immediately after the start of feeding, a corresponding pulse count index value P1 (hereinafter, the pulse count index value corresponding to an Nth one of the detection pieces S, W is denoted by PN (N is an integer of one or more) (see FIG. 6A). Since the average value calculable at this stage does not exist, the calculation is not performed and the remaining amount is not displayed (see FIG. 6B).

Subsequently, when a second one of the detection pieces S, W is detected and a corresponding pulse count index value P2 is calculated (see FIG. 6A), a sum P1+P2 with the previous pulse count index value P1 is defined as a determination object value X1. An average value is then calculated as the average value of the current pulse count index value and the previous pulse count index value P2, i.e., a sum y1 of P1+P2 is divided by two to calculate Y1, i.e., Y1=average(y1). A remaining amount rank corresponding to the calculated pulse count index value average value Y1 is determined, and a remaining amount display (display with a black bar in this example. see FIG. 7 described later) is performed in accordance with the determined remaining amount rank on the display part 500 (if any type of remaining amount display is already performed, the display is updated to a new display. the same applies hereinafter). A lock of the remaining amount display will be described later.

As described above, a table shown in FIG. 7 is stored in the memory 193 in advance and describes a predetermined correlation between the remaining amount of the ink ribbon 93 and the pulse count index value. In this example, this table includes a plurality of remaining amount ranks (six ranks 1 to 6 in this example) is set from the long remaining amount side to the short remaining amount side. In particular, if the pulse count index value average value calculated as described above is 87 or more as shown, (since the remaining amount of the ink ribbon 93 is estimated to be 75 m or more and less than 100 m) the remaining amount rank is "1". In accordance with this rank "1", a considerably long black bar corresponding to the highest remaining amount rank shown in a rightmost field in FIG. 7 is displayed on the display part 500. Therefore, it can be said that this bar represents the rank "1" and it can also be said that this bar represents the remaining amount of the ink ribbon 93 itself equal to or greater than 75 m and less than 100 m (the same applies hereinafter). Similarly, if the calculated pulse count index value average value is 77 or more and less than 87 (described as "~86" for convenience in FIG. 7. the same applies hereinafter), (since the remaining amount of the ink ribbon 93 is estimated to be 50 m or more and less than 75 m) the remaining amount rank is "2" and a black bar slightly shorter than the bar of the remaining amount rank "1" is displayed on the display part 500. Similarly, if the calculated pulse count index value average value is 65 or more and less than 77, (since the remaining amount of the ink ribbon 93 is estimated to be 25 m or more and less than 50 m) the remaining amount rank is "3" and a black bar slightly shorter than the bar of the remaining amount rank "2" is displayed on the display part 500. Similarly, if the calculated pulse count index value average value is 57 or more and less than 65, (since the remaining amount of the ink ribbon 93 is estimated to be 10 m or more and less than 25 m) the remaining amount rank is "4" and a black bar considerably shorter than the bar of the remaining amount rank "3" is displayed on the display part 500. Similarly, if the calculated pulse count index value average value is 54 or more and less than 57, (since the remaining amount of the ink ribbon 93 is estimated to be 5 m or more and less than 10 m) the remaining amount rank is "5" and a black bar shorter than the bar of the remaining amount rank "4" is displayed on the display part 500. If the calculated pulse count index value average value is less than 54, (since the remaining amount of the ink ribbon 93 is estimated to be less than 5 m) the remaining amount rank is "6" and a black bar shorter than the bar of the remaining amount rank "5" is displayed on the display part 500.

Returning to FIG. 6, when a third one of the detection pieces S, W is subsequently detected and a corresponding pulse count index value P3 is calculated (see FIG. 6A), a sum P2+P3 with the previous pulse count index value P2 is defined as a determination object value X2. In this case, as is the case with the pulse count index value P2 corresponding to the second one of the detection pieces S, W, the average value of the previous pulse count index values P1, P2 is calculated, i.e., the sum y1 of P1+P2 is divided by two to calculate Y1, i.e., Y1=average(y1). Since the calculated value is the same as that at the time of the pulse count index value P2, a new remaining amount display is not performed (in other words, the remaining amount display is not updated) (see FIG. 6B).

Similarly, when a fourth one of the detection pieces S, W is subsequently detected and a corresponding pulse count index value P4 is calculated (see FIG. 6A), a sum P3+P4 with the previous pulse count index value P3 is defined as a determination object value X3. In this case, the average value is calculated as an average value of the current pulse count index value P4 and the previous pulse count index values P1, P2, P3, i.e., a sum y2 of P1+P2+P3+P4 is divided by four to calculate Y2, i.e., Y1=average(y2). The remaining amount rank corresponding to a value of the calculated pulse count index value average value Y2 is determined with the technique described above with reference to FIG. 7, and the remaining amount display (the display update) corresponding to the determined remaining amount rank is performed on the display part 500.

When a fifth one of the detection pieces S, W is subsequently detected and a corresponding pulse count index value P5 is calculated (see FIG. 6A), a sum P4+P5 with the previous pulse count index value P4 is defined as a determination object value X4. In this case, as is the case with the pulse count index value P4 corresponding to the fourth one of the detection pieces S, W, the average value of the previous pulse count index values P1, P2, P3, P4 is calculated, i.e., the sum y2 of P1+P2+P3+P4 is divided by four to calculate Y2, i.e., Y2=average(y2). Since the calculated value is the same as that at the time of the pulse count index value P4, a new remaining amount display is not performed (in other words, the remaining amount display is not updated) (see FIG. 6B).

Similarly, when a sixth one of the detection pieces S, W is subsequently detected and a corresponding pulse count index value P6 is calculated (see FIG. 6A), a sum P5+P6 with the previous pulse count index value P5 is defined as a determination object value X5. In this case, the average value is calculated as an average value of the current pulse count index value P6 and the previous pulse count index values P1, P2, P3, P4, P5, i.e., a sum y3 of P1+P2+P3+P4+P5+P6 is divided by six to calculate Y3, i.e., Y3=average (y3). The remaining amount rank corresponding to a value of the calculated pulse count index value average value Y3 is determined with the technique described above with reference to FIG. 7, and the remaining amount display (the display update) corresponding to the determined remaining amount rank is performed on the display part 500.

When a seventh one of the detection pieces S, W is subsequently detected and a corresponding pulse count index value P7 is calculated (see FIG. 6A), a sum P6+P7 with the previous pulse count index value P6 is defined as a determination object value X6. In this case, as is the case with the pulse count index value P6 corresponding to the sixth one of the detection pieces S, W, the average value of the previous pulse count index values P1, P2, P3, P4, P5, P6 is calculated, i.e., the sum y3 of P1+P2+P3+P4+P5+P6 is divided by six to calculate Y3, i.e., Y3=average(y3). Since the calculated value is the same as that at the time of the pulse count index value P6, a new remaining amount display is not performed (in other words, the remaining amount display is not updated) (see FIG. 6B).

Similarly, when an eighth one of the detection pieces S, W is subsequently detected and a corresponding pulse count index value P8 is calculated (see FIG. 6A), a sum P7+P8 with the previous pulse count index value P7 is defined as a determination object value X7. In this case, the average value is calculated as an average value of the current pulse count index value P8 and the previous pulse count index values P1, P2, P3, P4, P5, P6, P7, i.e., a sum y3 of P1+P2+P3+P4+P5+P6+P7+P8 is divided by six to calculate Y4, i.e., Y4=average(y4). The remaining amount rank corresponding to a value of the calculated pulse count index value average value Y4 is determined with the technique described above with reference to FIG. 7, and the remaining amount display (the display update) corresponding to the determined remaining amount rank is performed on the display part 500.

When a ninth one of the detection pieces S, W is subsequently detected and a corresponding pulse count index value P9 is calculated (see FIG. 6A), a sum P8+P9 with the previous pulse count index value P8 is defined as a determination object value X8. In this case, as is the case with the pulse count index value P8 corresponding to the eighth one of the detection pieces S, W, the average value of the previous pulse count index values P1, P2, P3, P4, P5, P6, P7, P8 is calculated, i.e., the sum y4 of P1+P2+P3+P4+P5+P6+P7+P8 is divided by eight to calculate Y4, i.e., Y4=average (y4). Since the calculated value is the same as that at the time of the pulse count index value P8, a new remaining amount display is not performed (in other words, the remaining amount display is not updated) (see FIG. 6B).

Similarly, when a tenth one of the detection pieces S, W is subsequently detected and a corresponding pulse count index value P10 is calculated (see FIG. 6A), a sum P9+P10 with the previous pulse count index value P9 is defined as a determination object value X9. In this case, the average value is calculated as an average value of the current pulse count index value P10 and the previous pulse count index values P1, P2, P3, P4, P5, P6, P7, P8, P9, i.e., a sum y5 of P1+P2+P3+P4+P5+P6+P7+P8+P9 is divided by ten to calculate Y5, i.e., Y5=average(y5). The remaining amount rank corresponding to a value of the calculated pulse count index value average value Y5 is determined with the technique described above with reference to FIG. 7, and the remaining amount display (the display update) corresponding to the determined remaining amount rank is performed on the display part 500.

The same calculation is subsequently repeated until a 99th one of the detection pieces S, W is detected and a corresponding pulse count index value P99 is calculated.

An ordinal number k of FIG. 6B will be described later.

<Locking Process in Remaining Amount Display>

A locking process in the remaining amount display shown in FIG. 6B will be described. when the remaining amount is determined from an optical detection result of the detection pieces S, W associated with the rotation of the encoder plate 25 as described above, even though the actual remaining amount successively decreases due to continuous feeding, the determined remaining amount may contrarily increase due to rotational unevenness of the encoder plate 25 and thickness unevenness of the ink ribbon 93, for example. In such a case, if the corresponding rank display is directly performed on the remaining amount display part 500, the rank display may move back and forth between the long remaining amount side and the short remaining amount side in a short time and the user may be confused. Therefore, in this embodiment, if the remaining amount rank newly determined with the technique described above with reference to FIG. 7 is determined as the remaining amount rank on the longer remaining amount side, this determination is ignored to continue the remaining amount display at the current rank (locking process). In this embodiment, although this process is always executed in principle when a new remaining amount display is performed (see the remaining amount display lock "YES" in FIGS. 8B and 9B described later), this process is exceptionally not performed until the encoder plate 25 rotates once as described with reference to FIGS. 6A and 6B (see the remaining amount display lock "NO" in FIG. 6B).

<Until Encoder Plate Rotates Twice after Having Rotated Once>

In this embodiment, after the encoder plate 25 has rotated once, as in the above description, the sum of the latest pulse count index value P and the previous pulse count index value P is defined as a determination object value, and an average value of a predetermined range (in this example, the average value of 100 pieces of the pulse count index value data corresponding to just one round of the encoder plate 25) is calculated out of the already calculated pulse count index value data.

For example, when a 100th one of the detection pieces S, W is detected at the end of the first round and immediately before the second round of rotation of the encoder plate 25 and a corresponding pulse count index value P100 is calculated (see FIG. 8A), a sum P99+P100 with the previous pulse count index value P99 is defined as a determination object value X99. In this case, a sum y50 of the last 100 pulse count index values P1, P2, . . . P99, P100 including the corresponding pulse count index value P100 is divided by 100 to calculate Y50, i.e., Y50=average(y50). The remaining amount rank corresponding to a value of the calculated pulse count index value average value Y50 is determined with the technique described above with reference to FIG. 7, and the remaining amount display (the display update) corresponding to the determined remaining amount rank is performed on the display part 500 (see FIG. 8B). In this case, the remaining amount display locking process described above is also executed.

Similarly, when a 101st one of the detection pieces S, W is subsequently detected and a corresponding pulse count index value P101 is calculated (see FIG. 8A), a sum P100+P101 with the previous pulse count index value P100 is defined as a determination object value X100. In this case, as is the case with the pulse count index value P100 corresponding to the 100th one of the detection pieces S, W, the average value Y50=average(y50) is calculated from the pulse count index values P101−P100 that are the latest 100 pieces of data including the previous pulse count index value P100. The remaining amount rank corresponding to a value of the calculated pulse count index value average value Y50 is determined with the technique described above with reference to FIG. 7; however, the corresponding remaining amount display (the display update) is not performed (see FIG. 8B).

Similarly, at the time of detection of a 102nd one of the detection pieces S, W, a sum P101+P102 of the pulse count index values P is defined as a determination object value X101, and a sum y51 (P3+ . . . +P102) of the last 100 pulse count index values P including the current value is divided by 100 to calculate Y51=average(y51) before the corresponding remaining amount rank is determined (see FIG. 8B). At the time of detection of a 103rd one of the detection pieces S, W, a sum P102+P103 of the pulse count index values P is defined as a determination object value X102, and the Y51=average(y51) to the pervious pulse count index value P102 is calculated before the corresponding remaining amount rank is determined (see FIG. 8B).

Similarly, at the time of detection of a 104th one of the detection pieces S, W, a sum P103+P104 of the pulse count index values P is defined as a determination object value X103, and a sum y52 (P5+ . . . +P104) of the last 100 pulse count index values P including the current value is divided by 100 to calculate Y52=average(y52) before the corresponding remaining amount rank is determined (see FIG. 8B). At the time of detection of a 105th one of the detection pieces S, W, a sum P104+P105 of the pulse count index values P is defined as a determination object value X104, and the Y52=average(y52) to the pervious pulse count index value P104 is calculated before the corresponding remaining amount rank is determined (see FIG. 8B).

Similarly, at the time of detection of a 106th one of the detection pieces S, W, a sum P105+P106 of the pulse count index values P is defined as a determination object value X105, and a sum y53 (P7+ . . . +P106) of the last 100 pulse count index values P including the current value is divided by 100 to calculate Y53=average(y53) before the corresponding remaining amount rank is determined (see FIG. 8B).

The same calculation is subsequently repeated until a 200th one of the detection pieces S, W is detected and a corresponding pulse count index value P200 is calculated.

The ordinal number k of FIG. 8B will be described later.

<After Encoder Plate has Rotated Twice>

Further, after the encoder plate 25 has rotated twice, as in the above description, the sum of the latest pulse count index value P and the previous pulse count index value P is defined as a determination object value, and an average value of a predetermined range (in this example, the average value of 100 pieces of the pulse count index value data for just one round of the encoder plate 25) is calculated out of the already calculated pulse count index value data.

For example, when a 200th one of the detection pieces S, W is detected at the end of the second round and immediately before the third round of rotation of the encoder plate 25 and a corresponding pulse count index value P200 is calculated (see FIG. 9A), a sum P199+P200 with the previous pulse count index value P199 is defined as a determination object value X199. In this case, a sum y100 of the last 100 pulse count index values P101, P102, . . . P199, P200 including the corresponding pulse count index value P200 is divided by 100 to calculate Y100, i.e., Y100=average(y100). The remaining amount rank corresponding to a value of the calculated pulse count index value average value Y100 is determined with the technique described above with reference to FIG. 7, and the remaining amount display (the display update) corresponding to the determined remaining amount rank is performed on the display part 500 (see FIG. 9B). In this case, the remaining amount display locking process described above is also executed.

Similarly, when a 201st one of the detection pieces S, W is subsequently detected and a corresponding pulse count index value P201 is calculated (see FIG. 9A), a sum P200+P201 with the previous pulse count index value P200 is defined as a determination object value X200. In this case, as is the case with the pulse count index value P200 corresponding to the 200th one of the detection pieces S, W, the average value Y100=average(y100) is calculated from the pulse count index values P101–P200 that are the latest 100 pieces of data including the previous pulse count index value P200. The remaining amount rank corresponding to a value of the calculated pulse count index value average value Y100 is determined with the technique described above with reference to FIG. 7; however, the corresponding remaining amount display (the display update) is not performed (see FIG. 9B).

Similarly, at the time of detection of a 202nd one of the detection pieces S, W, a sum P201+P202 of the pulse count index values P is defined as a determination object value X201, and a sum y101 (P103+ . . . +P202) of the last 100 pulse count index values P including the current value is divided by 100 to calculate Y101=average(y101) before the corresponding remaining amount rank is determined (see FIG. 9B). At the time of detection of a 203rd one of the detection pieces S, W, a sum P202+P203 of the pulse count index values P is defined as a determination object value X202, and the Y101=average(y101) to the pervious pulse count index value P202 is calculated before the corresponding remaining amount rank is determined (see FIG. 9B).

Similarly, at the time of detection of a 204th one of the detection pieces S, W, a sum P203+P204 of the pulse count index values P is defined as a determination object value X203, and a sum y102 (P105+ . . . +P204) of the last 100 pulse count index values P including the current value is divided by 100 to calculate Y102=average(y102) before the corresponding remaining amount rank is determined (see FIG. 9B). At the time of detection of a 205th one of the detection pieces S, W, a sum P204+P205 of the pulse count index values P is defined as a determination object value X204, and the Y102=average(y102) to the pervious pulse count index value P204 is calculated before the corresponding remaining amount rank is determined (see FIG. 8B).

Similarly, at the time of detection of a 206th one of the detection pieces S, W, a sum P205+P206 of the pulse count index values P is defined as a determination object value X205, and a sum y103(P107+ . . . +P206) of the last 100 pulse count index values P including the current value is divided by 100 to calculate Y103=average(y103) before the corresponding remaining amount rank is determined (see FIG. 9B).

The same calculation is subsequently repeated until a 300th one of the detection pieces S, W is detected and a corresponding pulse count index value P300 is calculated. The ordinal number k of FIG. 9B will be described later.

After a 301th one of the detection pieces S, W is detected, the same calculation as described above is repeatedly executed.

<Control Procedure>

Control procedures executed by the CPU 191 of the printer 1 for implementing the technique will be described with reference to FIG. 10.

In FIG. 10, a process shown in this flowchart is triggered and started by a predetermined operation (e.g., a print start instructing operation) performed after the printer 1 is powered on.

First, at step S10, the CPU 191 determines whether the feeding of the ink ribbon 93 is started by driving of the platen roller 62 and the ribbon take-up shaft 63 by the drive motor 103. If the feeding is not started, this determination is negative (S10:NO) and the CPU 191 waits in a loop until the determination becomes affirmative. If the feeding is started, this determination is affirmative (S10:YES) and the CPU 191 goes to step S15. It is noted that the encoder plate 25 starts rotating in conjunction with this start of feeding as described above and the photosensor 26 starts detecting the detection pieces S, W of the rotating encoder plate 25.

At step S15, the CPU 191 acquires the total number M (M=64 in the example shown in FIG. 3) of the detection pieces S, W provided on the encoder plate 25 stored in advance in an appropriate place (e.g., the ROM 192).

At step S20, the CPU 191 sets a value of a variable N to N=0. The CPU 191 then goes to step S25.

At step S25, it is determined whether the photosensor 26 has detected an N+1th (N=0 by default and, therefore, first) one of the detection pieces S, W of the encoder plate 25, or in other words, whether a detection pulse corresponding to the detection pieces S, W (see FIGS. 5A, 5B, etc.) is input from the photosensor 26 via the input/output interface 195. The determination is negative (step S25:NO) and the CPU 191 waits in a loop until the N+1th one of the detection pieces S, W is detected and, if the N+1th one of the detection pieces S, W is detected, the determination is affirmative (step S25:YES) and the CPU 191 goes to step S30.

At step S30, the CPU 191 calculates the N+1th (N=0 by default and, therefore, first) pulse count index value $P_{N+1}$ based on the detection result of step S25 (see also FIGS. 6A, 6B, 8A, 8B, 9A, and 9B). The CPU 191 then goes to step S32.

At step S32, the CPU 191 determines whether the value of N at this point is equal to or greater than 1. If N<1 (i.e., N=0), the determination is negative (step S32:NO) and, after one is added to N at step S33, the CPU 191 returns to step S25 to repeat the same procedure. If N≥1, the determination is affirmative (step S32:YES) and the CPU 191 goes to step S35.

At step S35, the CPU 191 calculates a determination object value $X_N=P_{N+1}+P_N$ from the N+1th pulse count index value $P_{N+1}$ calculated at step S30 and the preceding Nth pulse count index value $P_N$ (already calculated at step S30 before returning from steps S32 through step S33 to step S25).

Subsequently, at step S40, the CPU 191 determines whether the value of N at this point is equal to or less than the value of M (N≤M) acquired at step S15. If N>M, this determination is negative (S40:NO) and the CPU 191 goes to step 50 described later and, if N≤M, this determination is affirmative (S40:YES) and the CPU 191 goes to step S45.

At step S45, the CPU 191 determines whether N is an odd number. If N is not an odd number (i.e., N is an even number), this determination is negative (S45:NO) and the CPU 191 goes to step S60 described later. If N is an odd number, this determination is affirmative (S45:YES) and the CPU 191 goes to step S55.

At step S55, the CPU 191 determines a natural number k satisfying N=2k−1. The CPU 191 then goes to step S75.

At step S75, the CPU 191 determines whether N is equal to or greater than three (N≥3). If N is less than three, this determination is negative (S75:NO) and the CPU 191 goes to step 140 described later and, if N is equal to or greater than three, this determination is affirmative (S75:YES) and the CPU 191 goes to step S85.

At step S85, the CPU 191 calculates an average value $Y_{k-1}$ (see FIG. 6) of $P1-P_{N-1}$ in accordance with the calculation result of step S30 up to this point. The CPU 191 then goes to step S101.

At step S101, the CPU 191 refers to the table shown in FIG. 7 and determines the remaining amount rank corresponding to the average value $Y_{k-1}$ calculated at step S85 to any one of the ranks 1 to 6. The CPU 191 then goes to step S140 described later.

On the other hand, at step S60 after the negative determination of step S45, the CPU 191 determines a natural number k satisfying N=2k. The CPU 191 then goes to step S90.

At step S90, the CPU 191 calculates an average value $Y_k$ (see FIG. 6) of $P1-P_N$ in accordance with the calculation result of the step S30 up to this point. The CPU 191 then goes to step S102.

At step S102, as is the case with step S101, the CPU 191 refers to the table shown in FIG. 7 and determines the remaining amount rank corresponding to the average value $Y_k$ calculated at step S90 to any one of the ranks 1 to 6.

Subsequently, at step S116, the CPU 191 outputs a display control signal to the display part 500 to perform the remaining amount display (see FIG. 7) corresponding to the rank determined at step S102 (if the remaining amount display is already performed, the display is updated). The CPU 191 then goes to step S140 described later.

On the other hand, at step S50 after the negative determination of step S40, as is the case with step S45, the CPU 191 determines whether N is an odd number. If N is not an odd number (i.e., N is an even number), this determination is negative (S50:NO) and the CPU 191 goes to step 70 described later. If N is an odd number, this determination is affirmative (S50:YES) and the CPU 191 goes to step S65.

At step S65, as is the case with step S55, the CPU 191 determines a natural number k satisfying N=2k−1. The CPU 191 then goes to step S95.

At step S95, the CPU 191 calculates an average value $Y_{k-1}$ (see FIGS. 8 and 9) of $P_{N-M}-P_{N-1}$ in accordance with the calculation result of step S103 up to this point. The CPU 191 then goes to step S103.

At step S103, as is the case with steps S101 and S102, the CPU 191 refers to the table shown in FIG. 7 and determines the remaining amount rank corresponding to the average value $Y_{k-1}$ calculated at step S95 to any one of the ranks 1 to 6. The CPU 191 then goes to step S117 described later.

On the other hand, at step S70 after the negative determination of step S50, as is the case with step S60, the CPU 191 determines a natural number k satisfying N=2k. The CPU 191 then goes to step S100.

At step S100, the CPU 191 calculates an average value $Y_k$ (see FIGS. 8 and 9) of $P_{N-M+1}-P_N$ in accordance with the calculation result of step S30 up to this point. The CPU 191 then goes to step S104.

At step S104, as is the case with steps S101-S103, the CPU 191 refers to the table shown in FIG. 7 and determines the remaining amount rank corresponding to the average value $Y_k$ calculated at step S100 to any one of the ranks 1 to 6. The CPU 191 then goes to step S117.

At step S117, the CPU 191 determines whether the value of N at this point is a multiple of the M (i.e., whether the encoder plate 25 has just rotated p times (p is an integer of one or more)). If N is not a multiple of M, the determination is negative (S117:NO) and the CPU 191 goes to step S140 described later. If N is a multiple of M, the determination is affirmative (S117:YES) and the CPU 191 goes to step S118.

At step S118, the CPU 191 determines whether the remaining amount rank determined at step S103 or S104 has changed to the lower remaining amount side than the remaining amount rank determined at step S103 or S104 (or step S101 or S102) at the previous time (i.e., in the flow of procedures at the value of N smaller by one). If the rank has changed to the higher remaining amount side or has not changed, the determination is negative (S118:NO) and the CPU 191 goes to Step S140 described later. If the rank has changed to the lower remaining amount side, the determination is affirmative (S118:YES) and the CPU 191 goes to Step S119.

At step S119, as is the case of step S116, the CPU 191 outputs the display control signal to the display part 500 to perform the remaining amount display (see FIG. 7) corresponding to the rank determined at step S103 (or step S104) (if the remaining amount display is already performed, the display is updated). The CPU 191 then goes to step S140.

At step S140, it is determined whether the feeding of the ink ribbon 93 started at step S10 is ended. If the feeding is not ended, this determination is negative (S140:NO) and, after one is added to N at step S145, the CPU 191 returns to step S25 to repeat the same procedure. If the feeding is ended, the determination of step S140 is affirmative (S140:YES) and this flow is ended.

Advantage of this Embodiment

As in the above description, in this embodiment, the remaining amount is detected as described above based on a change in the pulse count index value P (=the number of pulses of the driving pulse per detection piece S, M) in the decreasing transition of the remaining amount of the ink ribbon 93. In this case, when one pulse is applied as a drive pulse to the drive motor 103 to rotate the drive motor 103, the rotation amount is constant independently of the rotation speed. This will be described with reference to FIG. 11.

For example, FIG. 11A shows the behavior of the pulse count index value when the motor rotational speed is a relatively low speed (in other words, when the ink ribbon 93 is fed at a relatively low speed) at a predetermined remaining amount of the ink ribbon 93. In the example shown in FIG. 11A, one of the slits S is detected by the photosensor 26 due to the rotation of the encoder plate 25 while five pulses are output as the drive pulses (described as "drive motor pulse" in the figures), and one of the shield portions W is detected by the photosensor 26 due to the rotation of the encoder plate 25 while five pulses are output as the drive pulses. Therefore, in terms of the detection pieces S, W as a whole, one of the detection pieces S, W is detected by the photosensor 26 while five pulses are output as the drive pulses, so that the pulse count index value is five. In this case, because of the low speed, a relatively large time width is formed as both a time width to (see also FIG. 5A) from detection of rising of a convex pulse due to one of the slits S to detection of rising of the next convex pulse and a time width tB (see also FIG. 5A) from detection of falling of a concave pulse due to one of the shield portions W to detection of falling of the next concave pulse.

On the other hand, FIG. 11B shows the behavior of the pulse count index value when the motor rotational speed is a relatively high speed (in other words, when the ink ribbon 93 is fed at a relatively high speed) at the same remaining amount of the ink ribbon 93 as that of FIG. 11A. In FIG. 11B, because of the high speed, a time width smaller than that of FIG. 11A is formed as both the time width tA from detection of rising of a convex pulse due to one of the slits S to detection of rising of the next convex pulse and the time width tB from detection of falling of a concave pulse due to one of the shield portions W to detection of falling of the next concave pulse. However, in terms of the drive pulse, as is the case with FIG. 11A, one of the slits S is detected while five pulses are output as the drive pulses, and one of the shield portions W is detected while five pulses are output as the drive pulses. Therefore, as in the above description, one of the detection pieces S, W is detected while five pulses are output as the drive pulses, so that the pulse count index value is five.

Therefore, in this embodiment, the remaining amount of the ink ribbon 93 can be determined independently of the magnitude of the feeding speed of the ink ribbon 93 at a given point in time by using the drive pulse count index value. Consequently, as compared to the conventional technique of detecting the remaining amount by using a speed (specifically, an angular speed of the ribbon roll R1 of the wound ink ribbon 93) as a parameter, the remaining amount of the ink ribbon 93 can highly accurately and highly reliably be determined, and the corresponding remaining amount display (rank display) can be performed.

Additionally, being independent of the feeding speed produces an effect that the remaining amount can highly accurately be determined even during a so-called through-up operation at the start of feeding and a so-called through-down operation at the time of stopping the feeding. This will be described by taking the through-up operation as an example with reference to FIG. 12.

In a "through-up section" on the left side of FIG. 12, the time intervals of the drive pulses gradually become narrower because of acceleration of the motor rotation speed (in other words, the feeding speed). As a result, the time width tA from detection of rising of a convex pulse due to one of the slits S to detection of rising of the next convex pulse becomes gradually shorter, and the time width tB from detection of falling of a concave pulse due to one of the shield portions W to detection of falling of the next concave pulse also becomes gradually shorter. Subsequently in a "constant speed section" on the right side of FIG. 12, the motor rotation speed (in other words, the feeding speed) becomes constant and, therefore, the time intervals of the driving pulses are equal to each other. As a result, the time width to from detection of rising of a convex pulse due to one of the slits S to detection of rising of the next convex pulse becomes constant thereafter, and the time width tB from detection of falling of a concave pulse due to one of the shield portions W to detection of falling of the next concave pulse also becomes constant thereafter.

However, in terms of the drive pulses, the relationship is always maintained in both the "through-up section" and the "constant speed section" such that one of the slits S is detected while five pulses are output as the drive pulses and that one of the shield portions W is detected while five pulses are output as the drive pulses and, therefore, the pulse count index value is always five as in the above description.

Although neither shown nor described in detail, as is clear from the above, the same behavior occurs during through-down.

Therefore, in this embodiment, the remaining amount of the ink ribbon 93 can reliably be determined with the technique described above even in the case of production of a very short printed matter printed substantially only by the through-up/through-down operations.

As a result, according to this embodiment, the remaining amount of the ink ribbon 93 can highly accurately and highly reliably be determined to perform the corresponding remaining amount display (rank display), so that the amount of the usable ink ribbon 93 can visually clearly be recognized by a user. Consequently, the convenience for the user can be improved.

In this embodiment, the CPU 191 first calculates at step S35 of FIG. 10 the determination object value $X_N=P_N+P_{N+1}$ from the Nth pulse count index value $P_N$ and the N+1th pulse count index value $P_{N+1}$ adjacent thereto. This has the following significance. If the optical detection is performed for the encoder plate 25 as described above, both the slits S of the encoder plate 25 and the shield portions W between the slits S act as the detection pieces as described above. In this case, as already exemplarily illustrated in FIGS. 5A, 5B, 11A, 11B, 12, etc., the photosensor 26 detects the convex pulse due to the slits S and detects the concave pulse due to the shielding portions W, for example. In this state, if the width dimension of the slits S and the width dimension of the shielding portions W in the encoder plate 25 are the same, the time width of the convex pulse detected by the photosensor 26 is naturally supposed to be the same as the time width of the concave pulse.

Actually, however, as shown in FIG. 13, due to the influence of spreading (diffusion) of light at the time of passage through the slits S, the time of light transmission through the slits S becomes larger in proportion for the photosensor 26 than the time of light shielding by the shielding portions W. As a result, the time width of the convex pulse and the time width of the concave pulse naturally supposed to be the same may not be the same.

Additionally, as shown in FIG. 14, the same may occur also due to the magnitude relationship between a threshold value set at the time of optical detection and a signal value. In particular, if a "High" signal and a "Low" signal are divided at the threshold value of one, the time width of the convex pulse and the time width of the concave pulse are substantially the same; however, if "High" and "Low" are divided at the threshold value of two, the time width of the convex pulse (i.e., the output time of "High") becomes shorter than the time width of the concave pulse (i.e., the output time of "Low").

However, even if the influence as described above occurs, no change is made in the time width to (see FIGS. 5A, 5B, 11A, 11B, and 12) from detection of rising of a convex pulse due to one of the slits S to detection of rising of the next convex pulse and the time width tB (see FIGS. 5A, 5B, 11A, 11B, and 12) from detection of falling of a concave pulse due to one of the shield portions W to detection of falling of the next concave pulse, or in other words, the total time width of one convex pulse and one concave pulse. Focusing on this point, in this embodiment, as described above, the determination object value $X_N$ is calculated from the Nth pulse count index value $P_N$ (corresponding to one of the convex pulse and the concave pulse) and the N+1th pulse count index value $P_{N+1}$ adjacent thereto (corresponding to the other one of the convex pulse and the concave pulse) (see step S35 of FIG. 10). As a result, the high accuracy can be ensured without causing the concern about the optical detection.

Particularly in this embodiment, the process is executed by using almost all the already detected pulse count index values P until the detection pieces S, W are detected for one round of the encoder plate 25 after the start of feeding (see FIGS. 6A, 6B, and steps S85, S95, etc. of FIG. 10). As a result, the determination of the remaining amount and the corresponding rank display can reliably and accurately be performed.

Particularly in this embodiment, each time the detection pieces S, W are detected for one round of the encoder plate 25 after the start of feeding, the pulse count index values P corresponding to the detection pieces S, W of the last one round are excluded from the objects, and the process is executed by using the subsequent pulse count index values P (see FIGS. 8A, 8B, and steps S95, S100, etc. of FIG. 10). As a result, the determination of the remaining amount and the corresponding rank display can be performed with data appropriately organized to speed up calculations without unnecessarily increasing the number of data.

Particularly in this embodiment, if a newly determined remaining amount rank is determined as the remaining amount rank on the longer remaining amount side, the remaining amount display at the current rank is continued (such that this determination is ignored) (see step S118 etc. of FIG. 10). This enables the avoidance of the negative effect that the rank display moves back and forth between the long remaining amount side and the short remaining amount side in a short time and confuses the user as described above, and the convenience for the user can be improved.

The present disclosure is not limited to the embodiment and can variously be modified without departing from the spirit and the technical ideas thereof. Such modification examples will hereinafter be described in order.

(1) Exclusion Immediately after Start of Printing

In the embodiment, as described above with reference to FIGS. 6A and 6B, the average values Y1, Y2, . . . are calculated immediately after the start of feeding (in other words, immediately after the start of a printing operation); however, this is not a limitation. Specifically, such an operationally unstable state immediately after the start of feeding (in other words, immediately after the start of a printing operation) may be excluded from the object of processing such as determination of the remaining amount rank and the corresponding display as described above. As a result, the adverse influences due to the unstable state are eliminated so that the determination of the remaining amount and the corresponding display can more reliably and accurately be performed.

(2) Application to Other than Ink Ribbon

In the above embodiment, the elongated medium defined as a determination object of a consumption completed state is a thermal transfer printing ribbon used for thermal transfer printing on the tube 9 by heating from the printing head 61; however, this is not a limitation. Specifically, the technique described above may be applied to an elongated medium that is a print-receiving tape (corresponding to a print-receiving medium) fed out and consumed at the time of execution of printing from an appropriate roll wound in advance. Moreover, the technique described above may be applied even to an elongated medium that is a print-receiving tube such as the tube 9 as long as the tube is fed out and consumed at the time of execution of printing from an appropriate roll wound in advance.

(3) Exclusion Immediately Before Cutting and Immediately after Cutting

For example, if a print-receiving tape or a print-receiving tube is used as the elongated medium as described above in (2), the medium is cut in some cases by a cutter (the cutter 64 in this example) provided in the printer at a desired length of the user after print formation by the printing head. This modification example corresponds to such a case and, rather than executing all the processes of the calculation of the average value of the pulse count index values, the determination of the corresponding remaining amount rank, and the remaining amount display as described above, at least one of the processes is interrupted during a predetermined period before and after the cutting operation by the cutter, and all the processes including the interrupted process are executed at the timing other than the predetermined period.

In this modification example, by excluding an operationally unstable state at the time of cutting by the cutter, the adverse influences due to the unstable state are excluded so that the determination of the remaining amount and the corresponding display can more reliably and accurately be performed.

(4) Other

It is noted that terms "vertical," "parallel," "plane," etc. in the above description are not used in the exact meanings thereof. Specifically, these terms "vertical," "parallel," "plane," etc. allow tolerances and errors in design and manufacturing and have meanings of "substantially vertical," "substantially parallel," and "substantially plane," etc.

It is noted that terms "same," "equal," "different," etc. in relation to a dimension and a size of the exterior appearance in the above description are not used in the exact meaning thereof. Specifically, these terms "same," "equal," "different," etc. allow tolerances and errors in design and manufacturing and have meanings of "substantially the same," "substantially equal," and "substantially different," etc. However, when a value used as a predefined determination criterion or a delimiting value is described such as a threshold value and a reference value, the terms "same," "equal," "different," etc. used for such a description are different from the above definition and have the exact meanings.

In the above description, the arrows shown in FIG. 4 indicate an example of signal flow and are not intended to limit the signal flow directions.

The flowchart shown in FIG. 10 are not intended to limit the present disclosure to the shown procedures and the procedures may be added/deleted or may be executed in different order without departing from the spirit and the technical ideas of the disclosure.

The techniques of the embodiment and modification examples may appropriately be utilized in combination other than those described above.

What is claimed is:

1. A printer comprising:

a feeder configured to feed an elongated medium fed out from a roll with the elongated medium wound around an axis, the elongated medium being consumed during printing, a pulse motor configured to drive said feeder, a drive control device configured to output a pulse signal for driving said pulse motor, an object to be detected that is configured to rotate in conjunction with a rotation of said roll and includes M detection pieces provided along a circumferential direction, the M being an integer of two or more, an optical detection device configured to optically detect said detection pieces of said object to be detected, a display device configured to perform a desired display, a processor, and a memory, the memory storing computer-executable instructions that, when executed by the processor, cause the printer to perform:

a remaining amount determining process, and an index value detecting process, in said index value detecting process, in accordance with feeding of said elongated medium by said feeder driven by said pulse motor, pulse count index values each represented by the number of pulses of said pulse signal per each of said detection pieces being sequentially detected for said respective detection pieces, in said remaining amount determining process, a first process, a second process, a third process, and a fourth process being sequentially executed with N increased by one at a time in accordance with consumption of said elongated medium, in the first process, an Nth determination object value defined as a determination object being calculated from both an Nth pulse count index value after a start of feeding and an N+1th pulse count index value adjacent to the Nth pulse count index, among a plurality of said pulse count index values sequentially detected in said index value detecting process, N being an integer of one or more, in the second process, an average value being calculated from a plurality of successive pulse count index values in a predetermined range including a latest value that is an Nth pulse count index value when N is an even number or is an (N−1)th pulse count index value when N is an odd number of three or more, among a plurality of said pulse count index values sequentially detected in said index value detecting process, in the third process, out of remaining amount ranks preset in multiple stages from a long remaining amount side to a short remaining amount side, a respective remaining amount rank corresponding to said Nth determination object value being determined based on said average value calculated in said second process by using a predetermined correlation obtained in advance between a remaining amount of said elongated medium in said roll and said pulse count index value, in the fourth process, a rank display corresponding to said remaining amount rank determined in said third process being performed on said displaying device.

2. The printer according to claim 1, wherein slits provided in said object to be detected and portions each located between an adjacent two of said slits in said object to be detected act as said detection pieces.

3. The printer according to claim 1, wherein after one of said detection pieces is detected by said optical detection device, said index value detecting process is executed in accordance with a result of the detection.

4. The printer according to claim 1, wherein:

while detection of M pulse count index values of a same number as said detection pieces is not completed in said index value detecting process after the start of feeding by said feeder, in said second process of said remaining amount determining process, an average value is calculated from all the pulse count index values included in said predetermined range, wherein the range extends from a first pulse count index value to said Nth pulse count index value when N is an even number, and wherein the range extends from the first pulse count index value to an (N−1)th pulse count index value when N is an odd number of three or more.

5. The printer according to claim 4, wherein:

while the detection of M pulse count index values is not completed in said index value detecting process after the start of feeding by said feeder, after said Nth determination object value defined as the determination object is calculated in the first process in said remaining amount determining process, in the case that an average value is calculated in said second process from all the pulse count index values up to the Nth pulse count index value when N is an even number, the rank display corresponding to said remaining amount rank determined in said third process is performed on said displaying device correspondingly to a time of detection of the Nth pulse count index value in said fourth process, or in the case that an average value is calculated in said second process from all the pulse count index values up to the (N−1)th pulse count index value when N is an odd number of three or more, the rank display corresponding to said remaining amount rank determined in said third process is continuously performed on said displaying device correspondingly to a time of detection of an (N−1)th pulse count index value immediately before the Nth pulse count index in said fourth process.

6. The printer according to claim 4, wherein:

each time the detection of M×p pulse count index values is sequentially completed in said index value detecting process after the start of feeding by said feeder, in said remaining amount determining process, in said second process after a detection timing of the M×p pulse count index, an average value is calculated from all the pulse count index values included in said predetermined range as the plurality of pulse count index values in said predetermined range, wherein p is an integer of one or more, wherein the range extends from a (M×p+1)th pulse count index value to said Nth pulse count index value when N is an even number, and wherein the range extends from the (M×p+1)th pulse count index value to an (N−1)th pulse count index value when N is an odd number of three or more.

7. The printer according to claim 6, wherein each time the detection of the M×p pulse count index values is sequentially completed in said index value detecting process after the start of feeding by said feeder, the rank display corresponding to said remaining amount rank determined in said third process is performed on said displaying device correspondingly to a time of detection of the M×pth pulse count index value in said fourth process in said remaining amount determining process.

8. The printer according to claim 7, wherein in said remaining amount determining process, in the case that said first process to fourth process are executed with N increased by one at a time and said remaining amount rank determined in the third process latest is changed to a rank on the longer remaining amount side than said remaining amount rank determined in the third process previously, the rank display corresponding to said remaining amount rank before the change is continuously performed on the displaying device in the fourth process last.

9. The printer according to claim 1, wherein in said remaining amount determining process, at least one of the determination of said remaining amount rank in said third process and said rank display in said fourth process is not performed in a first predetermined period immediately after the start of feeding by said feeder.

10. The printer according to claim 1, further comprising a printing head configured to form a print on a print-receiving medium, wherein said elongated medium is a thermal transfer printing ribbon configured to perform thermal transfer printing on the said print-receiving medium by heating from said printing head, or is said print-receiving medium.

11. The printer according to claim 10, further comprising a cutter configured to cut said print-receiving medium after formation of the print by said printing head, wherein in said remaining amount determining process, at least one of the determination of said remaining amount rank in said third process and said rank display in said fourth process is not performed in a second predetermined period before and after a cutting operation by said cutter.

* * * * *